US011781332B2

(12) United States Patent
Hobaica et al.

(10) Patent No.: US 11,781,332 B2
(45) **Date of Patent: *Oct. 10, 2023**

(54) MODULAR POOL

(71) Applicant: CONCRETE POOL CONCEPTS, INC., South Easton, MA (US)

(72) Inventors: David E. Hobaica, Mansfield, MA (US); Robert Henry Hobaica, Raynham, MA (US)

(73) Assignee: CONCRETE POOL CONCEPTS, INC., South Easton, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/045,079

(22) Filed: Oct. 7, 2022

(65) Prior Publication Data

US 2023/0067953 A1 Mar. 2, 2023

Related U.S. Application Data

(63) Continuation of application No. 17/473,504, filed on Sep. 13, 2021, now Pat. No. 11,505,958.

(60) Provisional application No. 63/123,771, filed on Dec. 10, 2020.

(51) Int. Cl.

| | |
|---|---|
| ***E04H 4/00*** | (2006.01) |
| ***E04H 4/14*** | (2006.01) |
| ***E04H 4/12*** | (2006.01) |

(52) U.S. Cl.

CPC ..... *E04H 4/0093* (2013.01); *E04H 4/1272* (2013.01); *E04H 4/144* (2013.01)

(58) Field of Classification Search

CPC ..... E04H 4/0093; E04H 4/1272; E04H 4/144

USPC ..... 4/506; 52/223.3

See application file for complete search history.

(56) References Cited

U.S. PATENT DOCUMENTS

| | | | | |
|---|---|---|---|---|
| 3,596,296 | A | 8/1971 | Gertz et al. | |
| 3,824,751 | A * | 7/1974 | Shelander | E04H 7/20 52/223.3 |
| 4,015,383 | A * | 4/1977 | Crowley | E04H 7/20 52/223.3 |
| 5,114,274 | A | 5/1992 | Heiler, Jr. | |
| 6,637,162 | B1 | 10/2003 | Holland | |
| 6,854,223 | B1 | 2/2005 | Holland | |
| 8,336,263 | B2 | 12/2012 | Schultz et al. | |
| 8,869,469 | B2 | 10/2014 | Ludlow et al. | |
| 11,505,958 | B2 * | 11/2022 | Hobaica | E04H 4/0093 |
| 2015/0337551 | A1 | 11/2015 | Romano | |

(Continued)

FOREIGN PATENT DOCUMENTS

| | | | |
|---|---|---|---|
| AT | 507841 | B1 | 10/2010 |
| AT | 14111 | U1 | 4/2015 |
| CN | 109519004 | A | 3/2019 |

(Continued)

*Primary Examiner* — Tuan N Nguyen

(74) *Attorney, Agent, or Firm* — Lando & Anastasi, LLP

(57) ABSTRACT

A modular swimming pool includes a precast base unit and a precast riser unit that can be assembled at an installation site to define an interior volume in which a human can swim. The precast riser unit is secured to the base unit. The upper surface of the precast base unit and at least one internal surface of the precast riser unit define the interior volume of the modular pool when the precast base unit and the precast riser unit are secured together. A modular swimming pool assembly is also provided. A method of assembling a modular swimming pool is also provided.

20 Claims, 35 Drawing Sheets

(56) References Cited

U.S. PATENT DOCUMENTS

| | | | |
|---|---|---|---|
| 2019/0365602 | A1 | 12/2019 | Selinger |
| 2022/0186511 | A1 | 6/2022 | Hobaica et al. |

FOREIGN PATENT DOCUMENTS

| | | | |
|---|---|---|---|
| DE | 1955078 | A1 | 5/1971 |
| DE | 102012021795 | A1 | 5/2014 |
| ES | 2298037 | A1 | 5/2008 |
| FR | 2248734 | A5 | 5/1975 |
| FR | 2689552 | A1 | 10/1993 |
| FR | 2812323 | A1 | 2/2002 |

* cited by examiner

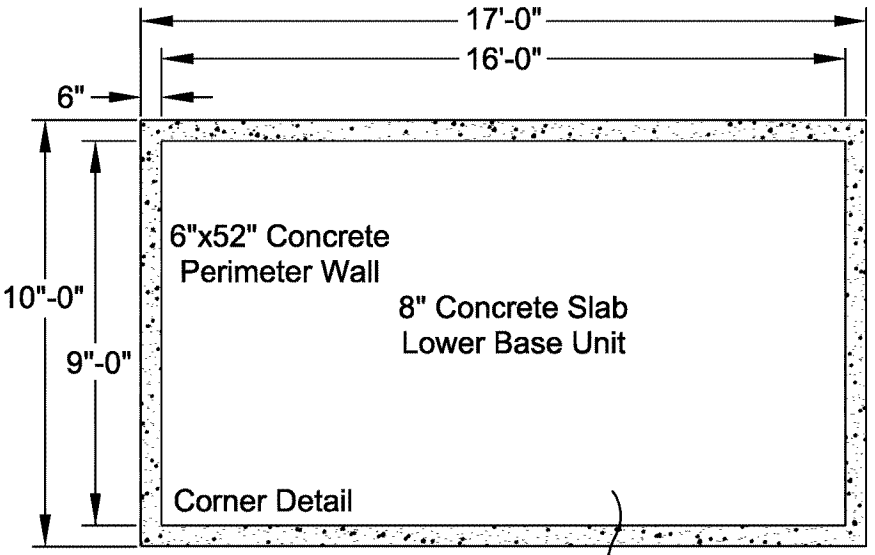
FIG. 16A
PLAN
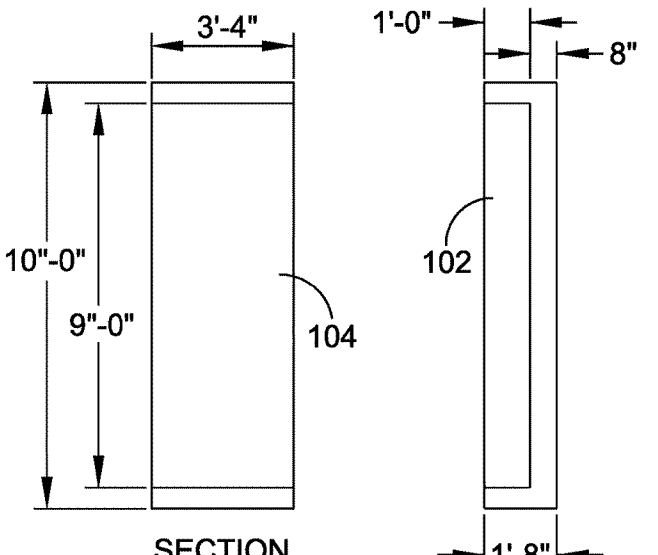
FIG. 16D
SECTION
UPPER UNIT
FIG. 16E
SECTION LOWER
BASE UNIT
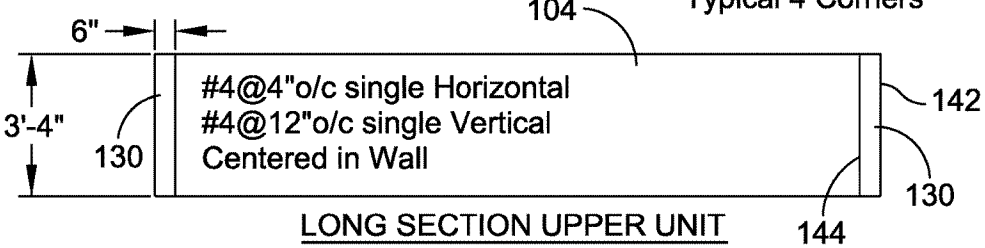
LONG SECTION UPPER UNIT
FIG. 16B
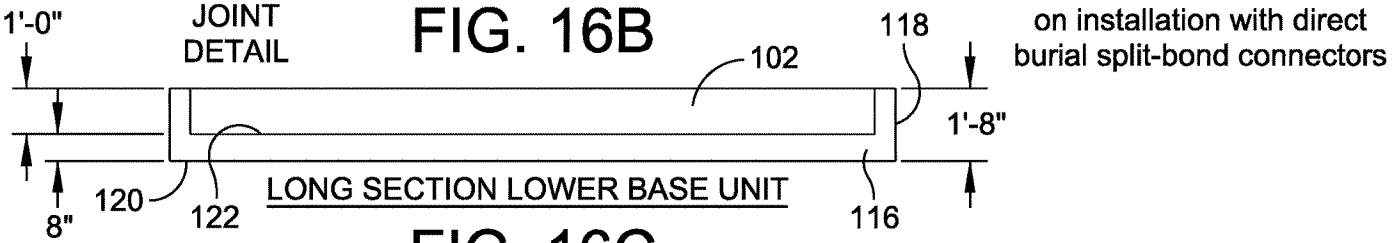
JOINT
DETAIL
LONG SECTION LOWER BASE UNIT
FIG. 16C

JOINT DETAIL

Continuous gang mold to make 5 at a time bench with spacer blocks 1 riser step 2 riser step

MODULAR POOL

CROSS REFERENCE TO RELATED APPLICATIONS

This application claims the benefit under 35 U.S.C. § 120 as a continuation of U.S. patent application Ser. No. 17/473,504 filed Sep. 13, 2021, which claims priority to U.S. Provisional Patent Application No. 63/123,771, filed on Dec. 10, 2020, each of which is hereby incorporated herein by reference in its entirety.

BACKGROUND OF DISCLOSURE

The present disclosure relates generally to swimming pools, including in-ground swimming pools. FIG. 1 shows a prior art in-ground swimming pool, generally indicated at 10, that was built using concrete blocks over two days. The pool includes a cast concrete portion that forms a bottom wall 12 and side walls 14. The cast portion defines an interior volume in which individual concrete blocks 16 are then arranged to form steps and a bench.

SUMMARY OF DISCLOSURE

An aspect of the present disclosure is directed to a modular swimming pool comprising a precast base unit having an upper surface and a precast riser unit secured to the base. The precast riser unit has at least one internal surface and an open upper end. The upper surface of the precast base unit and the at least one internal surface of the precast riser unit define an interior of the pool when the precast base unit and the precast riser unit are secured together.

In some embodiments, the precast riser unit includes at least one sidewall.

In some embodiments, the modular swimming pool further comprises at least one precast internal structure.

In some embodiments, the at least one precast internal structure includes at least one structure selected from a bench and a step.

In some embodiments, the modular swimming pool consists essentially of the precast base unit, the one precast riser unit, and the at least one precast internal structure.

In some embodiments, the riser unit is seated on the base unit and the at least one precast internal structure is positioned on the upper surface of the base unit.

In some embodiments, the precast riser unit includes at least one port in fluid communication with the interior of the pool.

In some embodiments, the at least one port includes a skimmer port.

In some embodiments, the at least one port includes a channel configured to be connected to external piping.

In some embodiments, the precast base unit and the precast riser unit are secured together by a joining material. In some such embodiments, the joining material is an adhesive material.

In some embodiments, the precast base unit and the precast riser unit are secured together by a joining material, and the precast base unit and the precast riser unit are secured together by the joining material. In some such embodiments, the joining material is an adhesive material.

Another aspect of the present disclosure is directed to a modular swimming pool assembly comprising a first modular swimming pool section and a second modular swimming pool section. The first modular swimming pool section includes a first precast base unit having an upper surface and a first precast riser unit secured to the first precast base unit, the first precast riser unit having at least one internal surface, wherein the upper surface of the first precast base unit and the at least one internal surface of the first precast riser unit define an interior of the first modular swimming pool when the first precast base unit and the first precast riser unit are secured together. The second modular swimming pool section includes a second precast base unit having an upper surface and a second precast riser unit secured to the second precast base unit, the second precast riser unit having at least one internal surface, wherein the upper surface of the second precast base unit and the at least one internal surface of the second precast riser unit define an interior of the second modular swimming pool when the first precast base unit and the first precast riser unit are secured together. An internal volume of the first modular swimming pool and an internal volume of the second modular swimming pool are in fluid communication.

In some embodiments, the first modular swimming pool section further includes a first opening defined in a side wall of the first precast riser unit, and the second modular swimming pool section further including a second opening defined in a side wall of the second precast riser unit. The side wall of the first precast riser unit is in directly adjacent facing relation with the side wall of the second precast riser unit and the first opening of the side wall of the first precast riser unit is aligned with the second opening of the second precast riser unit.

In some embodiments, the first precast base unit and the first precast riser unit are integrally formed and the second precast base unit and the second precast riser unit are integrally formed.

In some embodiments, the modular swimming pool assembly further comprises at least one precast internal structure.

In some embodiments, at least one precast internal structure includes at least one structure selected from a bench and a step.

In some embodiments, the modular swimming pool assembly consists essentially of the precast base unit, the one precast riser unit, and the at least one precast internal structure.

Another aspect of the present disclosure is directed to a method of assembling a modular swimming pool, the modular swimming pool including a precast base unit having an upper surface, a precast riser unit secured to the base, the precast riser unit having at least one internal surface, the upper surface of the precast base unit and the at least one internal surface of defining the interior of the pool when the precast base unit and the precast riser unit are secured together. The method comprises delivering the precast base unit and the precast riser unit to an installation site; positioning the precast base unit at the installation site; and securing the precast riser unit to the precast base unit so that the precast base unit and the precast riser unit define the interior of the modular swimming pool.

In some embodiments, the method further comprises adding a liner that extends over the upper surface of the base unit and the internal surface of the riser unit.

In some embodiments, the method further comprises using at least one blank to form at least one port on the riser unit in fluid communication with the interior of the pool.

In some embodiments, the port is a skimmer port.

In some embodiments, the port is a channel configured to be connected to external piping.

Another aspect of the present disclosure is directed to a modular pool comprising a precast base unit having an upper surface, and a precast riser unit secured to the base, the precast riser unit having at least one internal surface. The upper surface of the precast base unit and the at least one internal surface of the precast riser unit define an interior of the pool when the precast base unit and the precast riser unit are secured together.

In some embodiments, the precast riser unit includes at least one sidewall.

In some embodiments, the modular swimming pool further comprises at least one precast internal structure.

In some embodiments, the at least one precast internal structure includes at least one structure selected from a bench and a step.

In some embodiments, the modular swimming pool consists essentially of the precast base unit, the one precast riser unit, and the at least one precast internal structure.

In some embodiments, the precast riser unit includes at least one port in fluid communication with the interior of the pool.

Another aspect of the present disclosure is directed to a method of assembling a modular swimming pool, the modular swimming pool including a precast base unit having an upper surface, a precast riser unit secured to the base, the precast riser unit having at least one internal surface, the upper surface of the precast base unit and the at least one internal surface of defining the interior of the pool when the precast base unit and the precast riser unit are secured together, the method comprising delivering the precast base unit and the precast riser unit to an installation site; positioning the precast base unit at the installation site; and securing the precast riser unit to the precast base unit so that the precast base unit and the precast riser unit define the interior of the modular swimming pool.

Another aspect of the present disclosure is directed to a modular swimming pool and method of assembling a modular swimming pool as described and shown herein.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings:

FIG. 16A-16E is another set of blueprints for the embodiment of FIG. 15;

DETAILED DESCRIPTION

Figure 1:
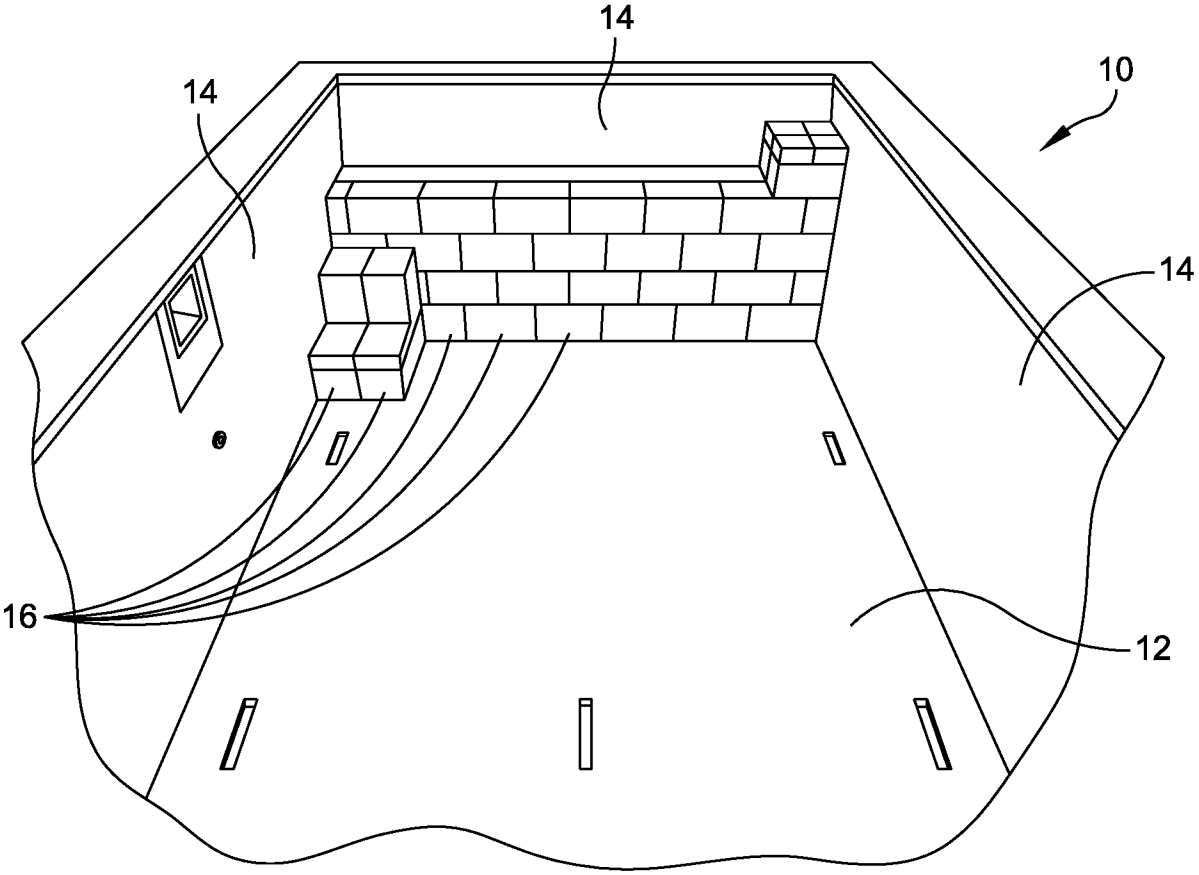
FIG. 1 (PRIOR ART)
FIG. 1 is a perspective view of a prior art swimming pool.

This disclosure is not limited in its application to the details of construction and the arrangement of components set forth in the following description or illustrated in the drawings. The disclosure is capable of other embodiments and of being practiced or of being carried out in various ways. Also, the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

The present disclosure relates to pools, particularly small swimming pools. In some embodiments, the small swimming pools are in-ground swimming pools. The small swimming pools that are known in the art are typically in the range of six feet to ten feet wide and no more than 20 feet in length. The primary advantages of this style of pool is lower cost, ease and speed of installation. These pools are typically made of concrete, steel panels, or fiberglass and can be surfaced with several different materials. In some embodiments, each pool has a bottom wall and four side walls. This size of pool goes by several names, such as "cocktail pool," "spool," "plunge pool" "garden pool," and other names.

A small swimming pool made of concrete has structural advantages over pools that are not made of concrete. However, typical concrete pool construction involves several time-consuming and costly steps. Some concrete pools are precast, monolithic pools that are built and poured offsite and then transported to the site and set using a crane or boom truck. However, most monolithic pools are installed using a crane, which is not suitable for installing a pool in some locations because of local buildings, terrain features, or other obstacles. Because of the weight of the monolithic pool, a sufficiently powerful crane must be used and at a significant cost.

In addition to enabling rigid manufacturing standards, the present disclosure provides a modular pool and a method for installing a modular pool that saves a considerable amount of time and labor relative to previously known methods of installing a pool.

In some embodiments, the modular pool of the present disclosure includes a plurality of concrete modules that are precast. In some embodiments, the precast modules of the modular pool are made in a factory setting to exacting manufacturing standards. The precast modules are then loaded on a flatbed truck, delivered to the installation site, and assembled piece by piece using a crane or boom truck.

In some embodiments, the two primary modules of the modular pool are a concrete base unit and a concrete riser unit. The base unit defines a bottom wall of the pool, and the riser unit defines at least one side wall of the pool. In some embodiments, at least one side wall defined by the riser unit is four side walls of the pool. By separating the modular pool into two modules instead of one monolithic pool, the modular pool can be loaded, transported, and installed on site without the use of a crane (unless there is not enough access for a boom truck) saving considerable time and money on installation.

In some embodiments, the precast modules include internal structures for the pool. For example, the internal structures can include one or more benches and/or one or more sets of step risers that are configured to be placed on the base of the pool. Once the riser unit is set on the base unit, the precast benches and steps are then set in place. These modules and method of installation saves considerable time, labor, and materials relative to the previously known method of building these interior features using cement blocks. These modules and method of installation enables the plunge pool to be more customizable than other similar pools.

In some embodiments, the precast modules also include precast concrete panels that attach to the exterior of the riser section of the pool when the pool is designed to be sitting above grade by 16"-18". Stone veneer is applied to the panels in a factory setting and the panels are shipped to the job site with the pool and the other precast modules. The precast panels and pre-application of the stone veneer saves a considerable amount of time and labor versus the prior known method of doing the work in the field where it is subject to the uncertainty of the weather.

In some embodiments, the precast modules also include precast "vaults" that are used to house the mechanism for an automatic cover. These precast "vaults" are made in a factory setting to exacting standards and are shipped to the site with the pool and other precast modules. The "vault" is then lowered into place with a boom truck or crane and attached to the side of the riser wall.

Because the individual modules of the pool are much lower in weight than a monolithic pool for a given pool interior volume, the modular pool of the present disclosure enables significantly larger pools to be easily transported and installed without the use of a crane (unless the installation crew cannot access the site with the boom truck). As a result, modular pools of the present disclosure can be significantly larger than previously known monolithic precast concrete pools (9 feet×21 feet vs 7 feet×13 feet) and do not typically require the use of a specialized crane. For example, an embodiment of a modular pool of the present disclosure having an inner footprint of 9 feet by 21 feet (outer footprint of 10 feet by 22 feet) can be installed with a boom truck, and without use of a specialized crane. Also, the modular design of the step inserts, benches, wall panels, and automatic cover vaults save significant time, labor, and materials over the alternative which is to build them using concrete blocks and mortar on-site.

Figure 2:
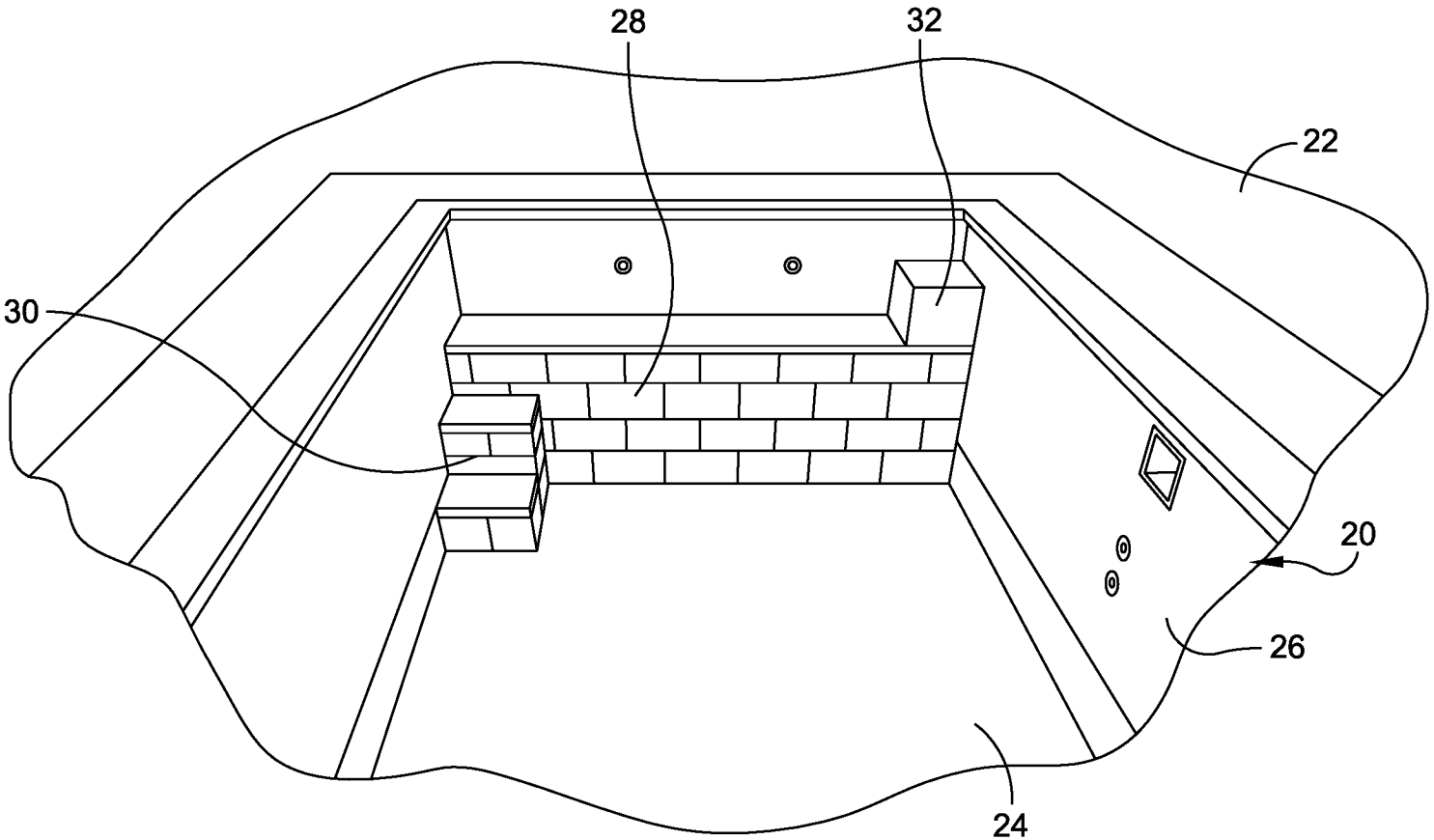
FIG. 2 is a perspective view of an embodiment of a modular pool according to the present disclosure.

For purposes of illustration, and with reference to FIG. 2, embodiments of the present disclosure will now be described with reference to a modular pool, generally indicated at 20, which can be subsequently lined, such as with a vinyl liner, frost-proof tile, or plaster, and used to contain water in which humans can swim. The modular pool 20 can be placed at least partially in-ground at a site 22, such as a backyard of a residential property.

The modular pool 20 includes a base unit 24 and a riser unit 26 that is supported on the base unit 24. Together the base unit 24 and the riser unit 26 define an interior volume of the modular pool 20, which is configured to serve as a reservoir for containing water. Within the interior volume of the modular pool 20, a variety of modular internal structures can be placed on the base unit 24. In FIG. 2, the internal structures include a bench 28, a bottom step 30, and a top step 32 supported on the bench 28. Each of the internal structures can be either precast or formed at the site 22.

The modular pool 20 is installed at a site by placing the base unit 24 in a hole that is dug into an area of ground at the intended installation site 22. The base unit 24 sits on the ground surface at a bottom of the hole. Then the riser unit 26 is placed on top of the base unit 24. A seal is formed between the riser unit 26 and the base unit 24 so that the base unit 24 and the riser 26 unit together define the interior volume of the modular pool 20 with an open upper end. In some embodiments, the interior volume is in the shape of a rectangular void. Then a liner (not shown), such as a liner made of vinyl, tile, or plaster, can be placed within the interior volume of the pool so that the liner covers the surfaces of the base unit 24, the riser unit 26, and the internal structures that were placed within the interior volume of the pool.

Figure 3:
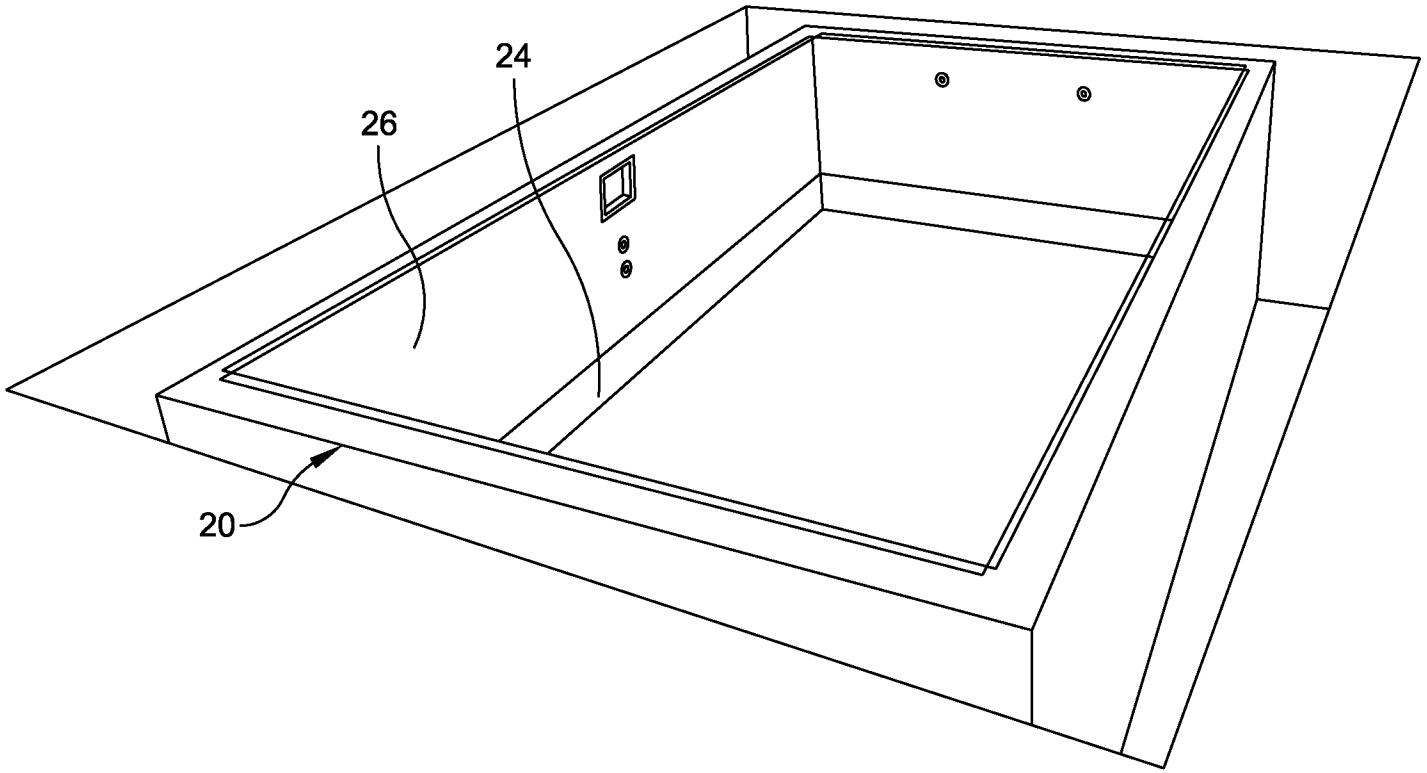
FIG. 3 is another perspective view thereof.
Figure 4:
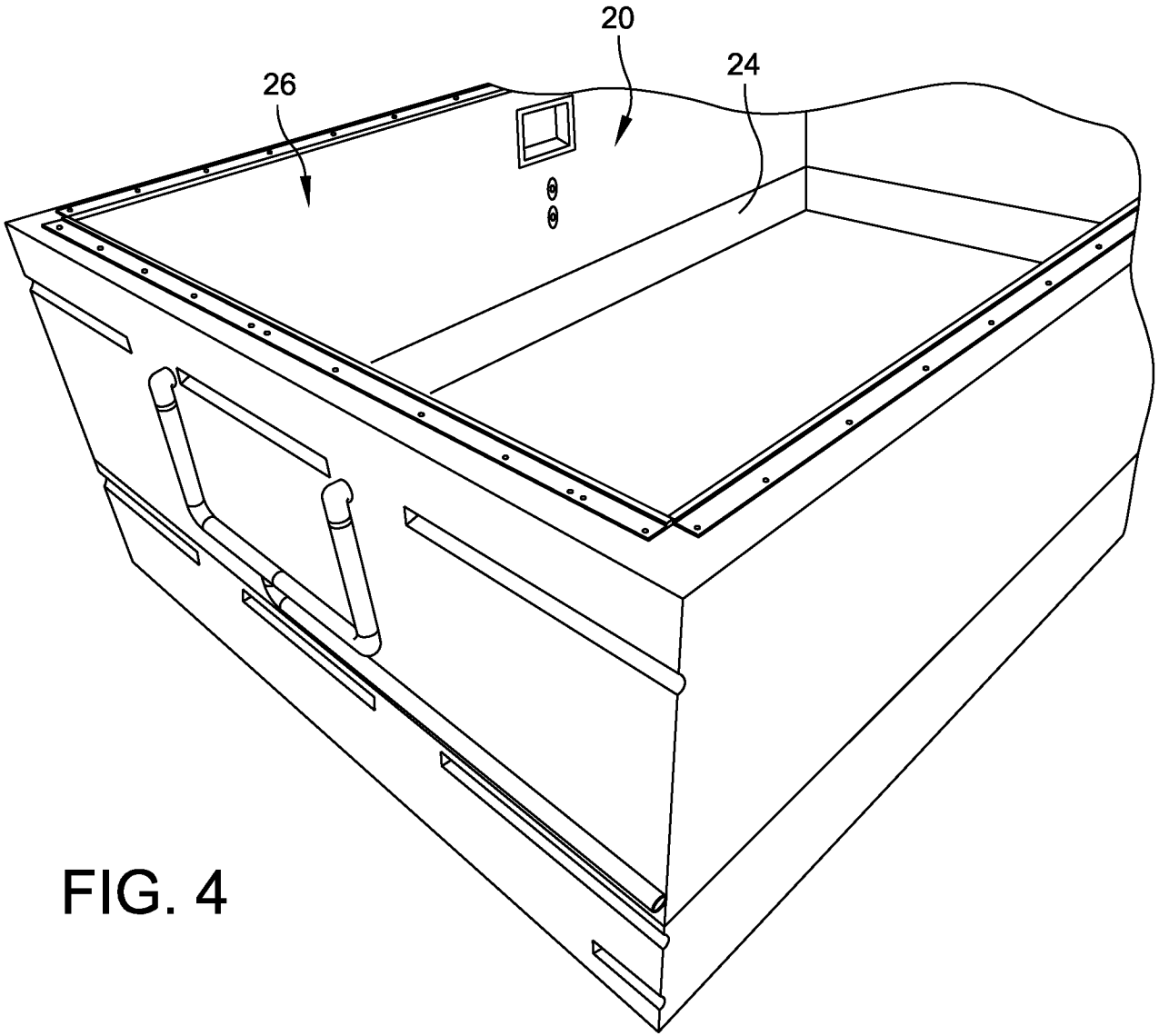
FIG. 4 is another perspective view thereof.

FIGS. 3 and 4 show additional perspective views of the modular pool 20 at the site.

Figure 5:
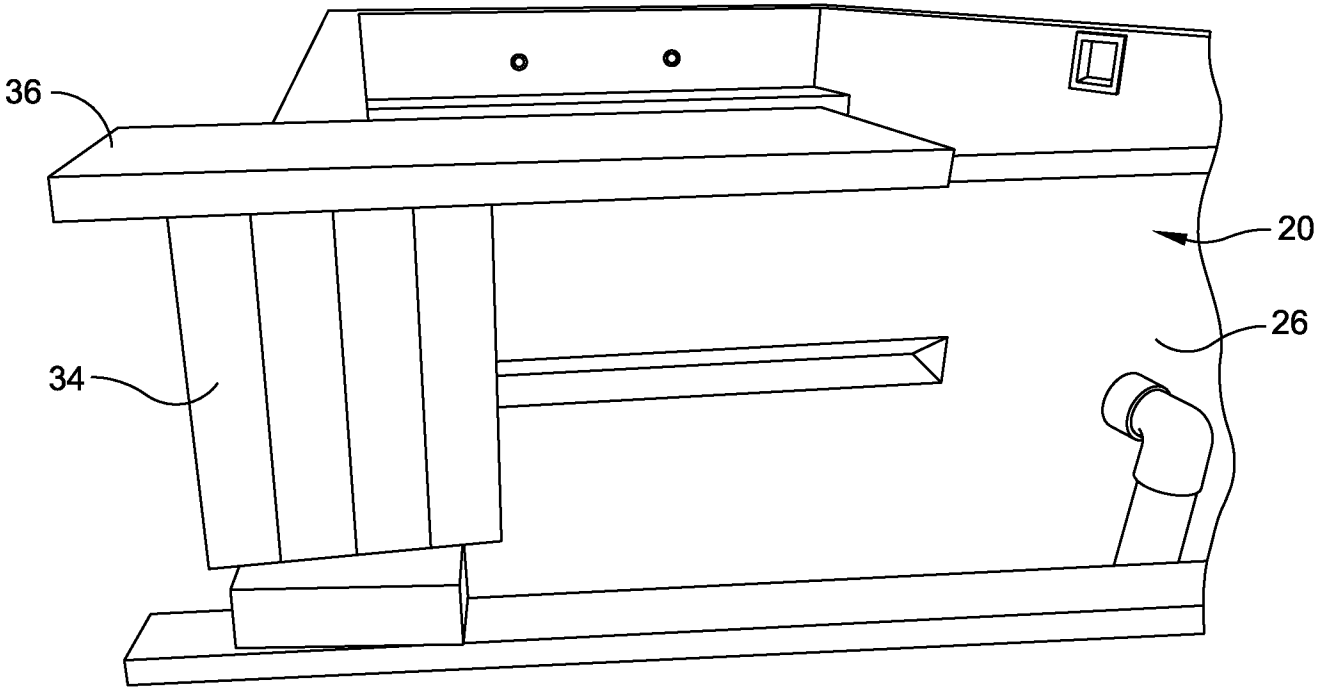
FIG. 5 is another perspective view thereof.

In some embodiments, siding panels, such as wood siding panels 34 as shown in FIG. 5, are placed around a portion of an exterior surface of riser that extends above the ground. FIG. 5 also shows an upper edging (coping) structure 36 that is placed over an upper end of the riser to provide a desired aesthetic appearance of the fully assembled modular pool 20.

Figure 6:
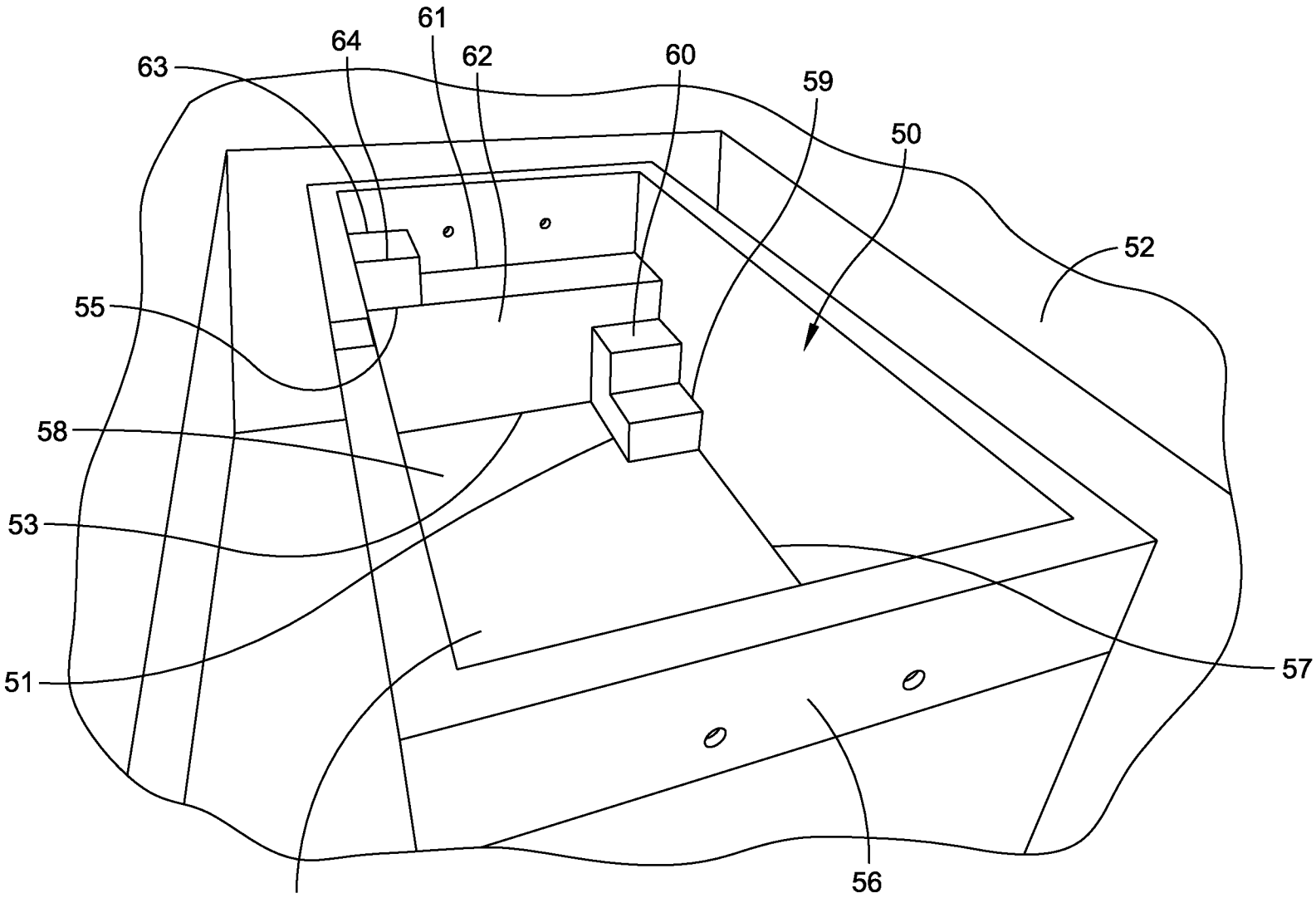
FIG. 6 is a perspective view of another embodiment of a modular pool according to the present disclosure.

FIG. 6 illustrates another embodiment of a modular pool, generally indicated at 50, of the present disclosure that is flush with the ground surface at a site 52. The modular pool 50 includes a base unit 54 and a riser unit 56 that is supported on the base unit 54. Together the base unit 54 and the riser unit 56 form a structure that defines an interior volume that can serve as a reservoir for containing water. Within the interior volume of the modular pool 50, a variety of modular internal structures can be placed on an upper surface 58 of the base unit 54. For example, in FIG. 6, the modular internal structures include a bottom step 60, a bench 62 adjacent to the bottom step 60, and a top step 64. The bottom step 60 and the bench 62 are supported on the upper surface 58 of the base unit 54. The top step 64 is supported on the bench 62.

Figure 7:
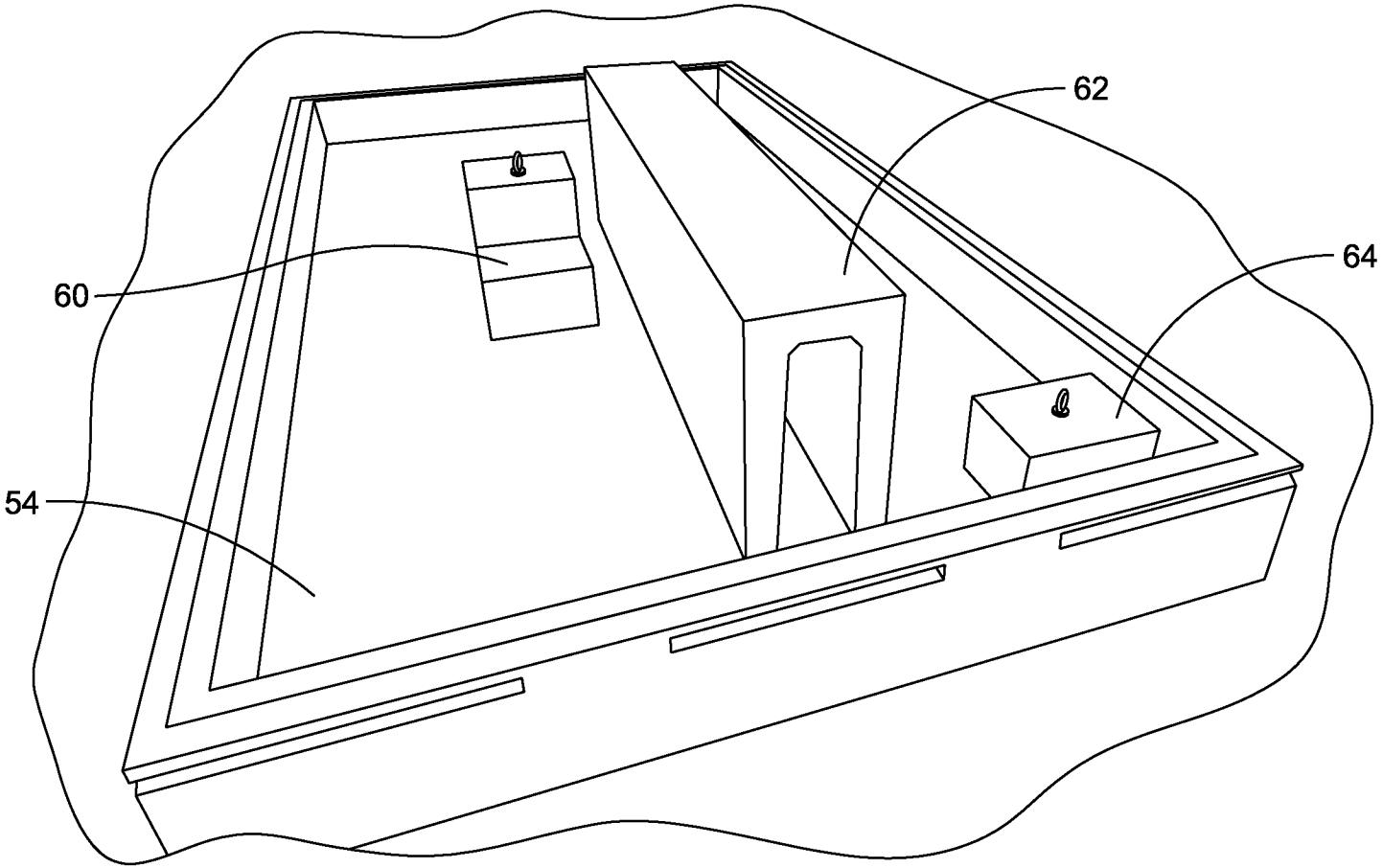
FIG. 7 is a perspective view of components of the modular pool of FIG. 6 in a first step of assembling the modular pool of FIG. 6.

FIGS. 7-14 illustrate steps of a method of installing the modular pool 50 of FIG. 6. In FIG. 7, the base unit 54 is seated on a recessed surface dug into an area of ground at the installation site 52. The modular internal structures are then lowered onto the base unit. In FIG. 7, the bottom step 60, the bench 62, and the top step 64 are placed on the upper surface 58 of the base unit and can be moved into their final installed positions later. The bottom step 60 is secured to the base unit 54 by a joining material at first interface 51. The bench 62 is secured to the base unit 54 by a joining material at second interface 53. The top step 64 is secured to the bench 62 by a joining material at third interface 55. The joining material at the first interface, the second interface, and the third interface may be an adhesion material. In some embodiments, the adhesion material consists essentially of mortar. In some embodiments, the adhesion material is mortar.

The riser unit 56 is then lowered onto the base unit 54 by operating a crane to lift and the lower the riser unit 56. The riser unit 56 is secured to the base unit 54 by a joining material at fourth interface 57. The bottom step 60 is secured to the riser unit 56 by a joining material at fifth interface 59. The bench 62 is secured to the riser unit 56 by a joining material at sixth interface 61. The top step is secured to the riser unit 56 by a joining material at seventh interface 63. The joining material at the fourth interface, the fifth interface, the sixth interface, and the seventh interface may be an adhesion material. In some embodiments, the adhesion material consists essentially of mortar. In some embodiments, the adhesion material is mortar.

Figure 8:
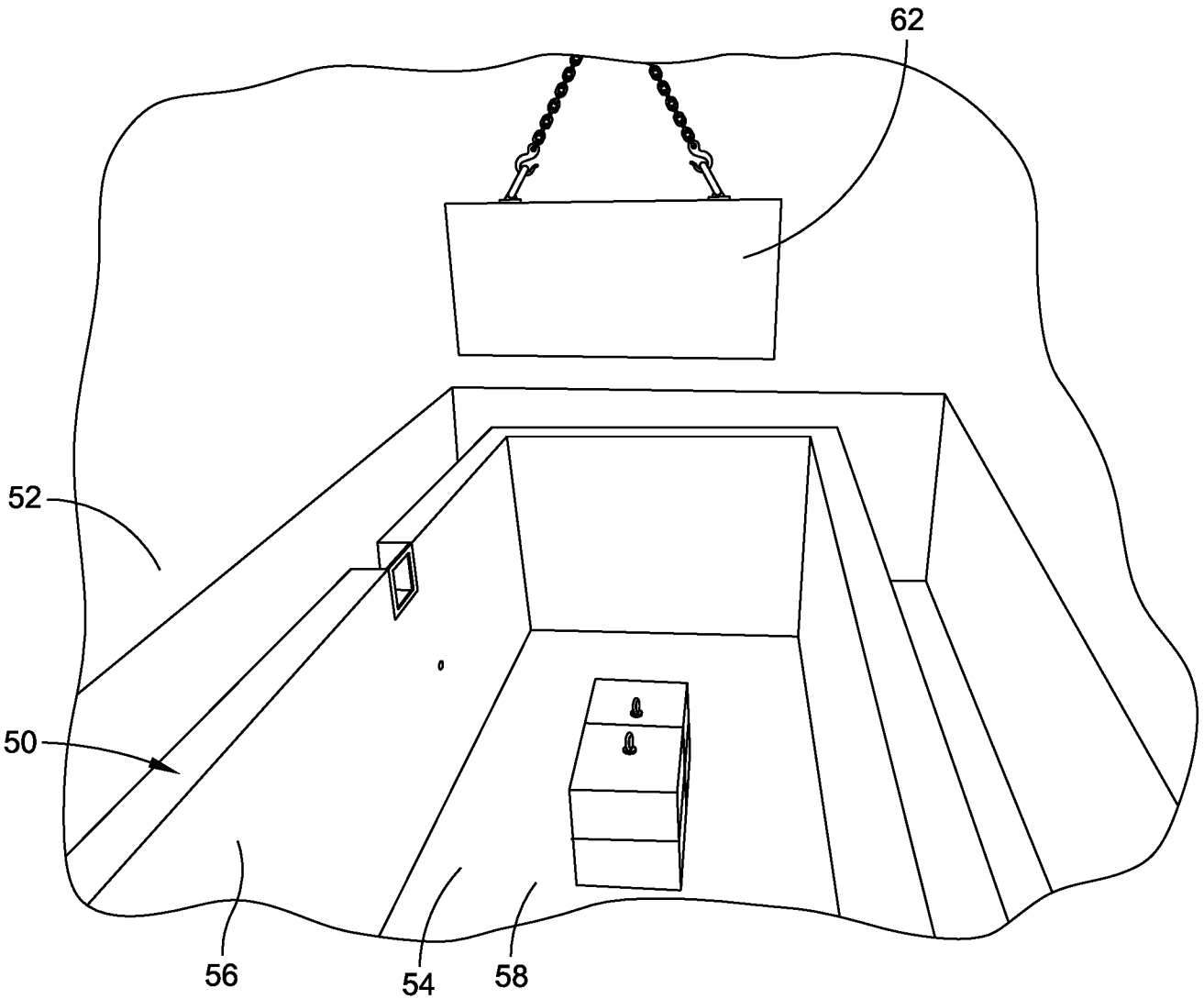
FIG. 8 is another view of a step of assembling the modular pool of FIG. 6.
Figure 9:
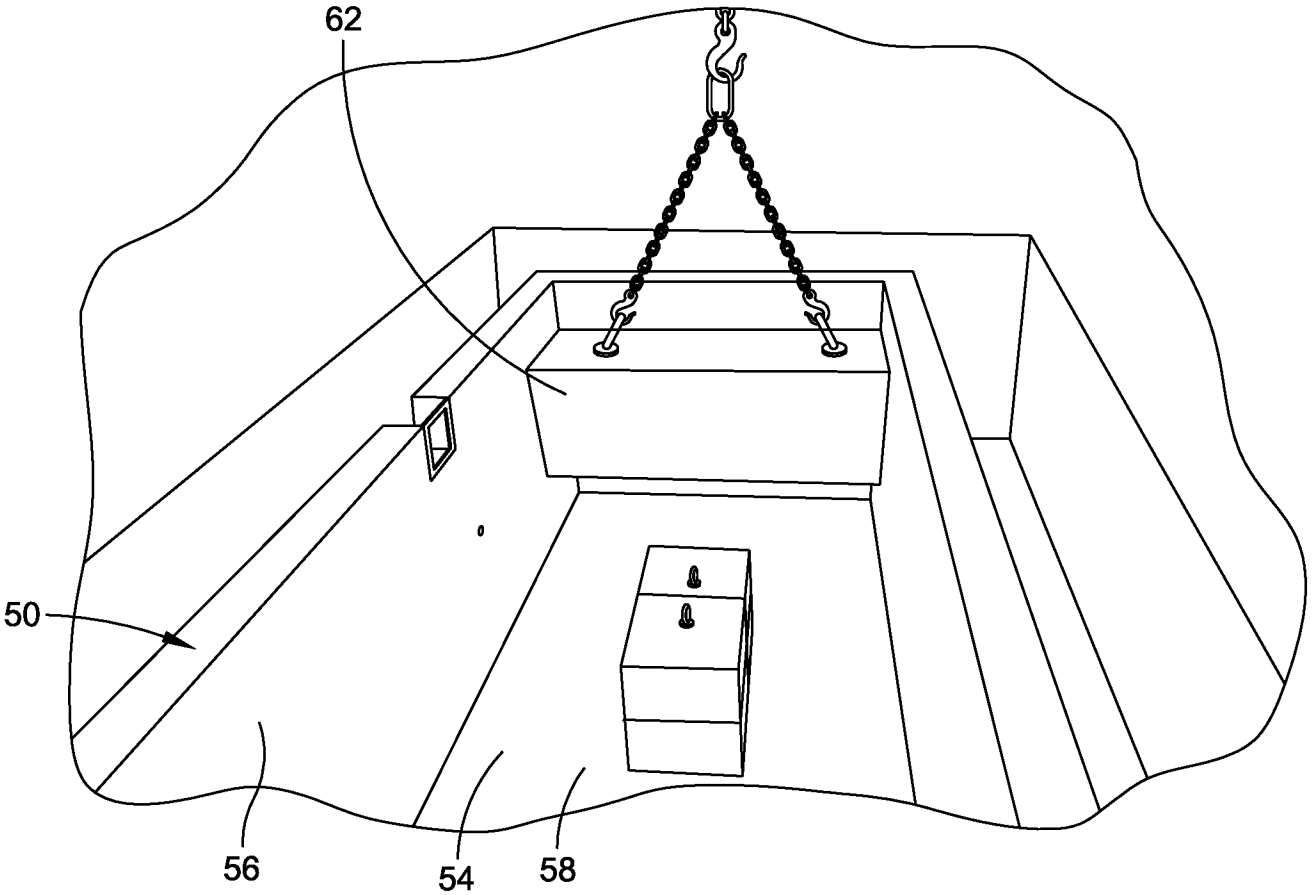
FIG. 9 is another view of a step of assembling the modular pool of FIG. 6.
Figure 10:
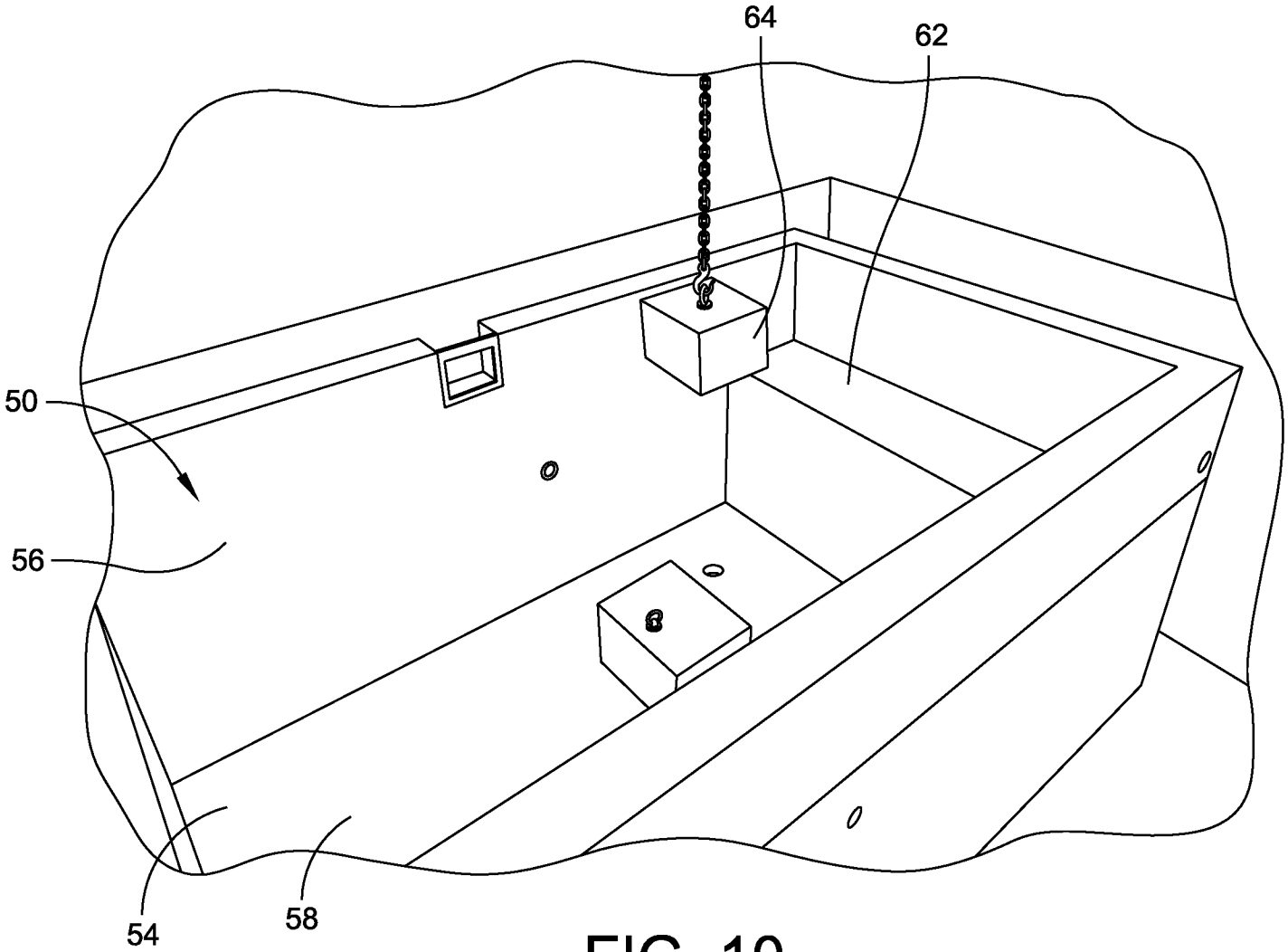
FIG. 10 is another view of a step of assembling the modular pool of FIG. 6.
Figure 11:
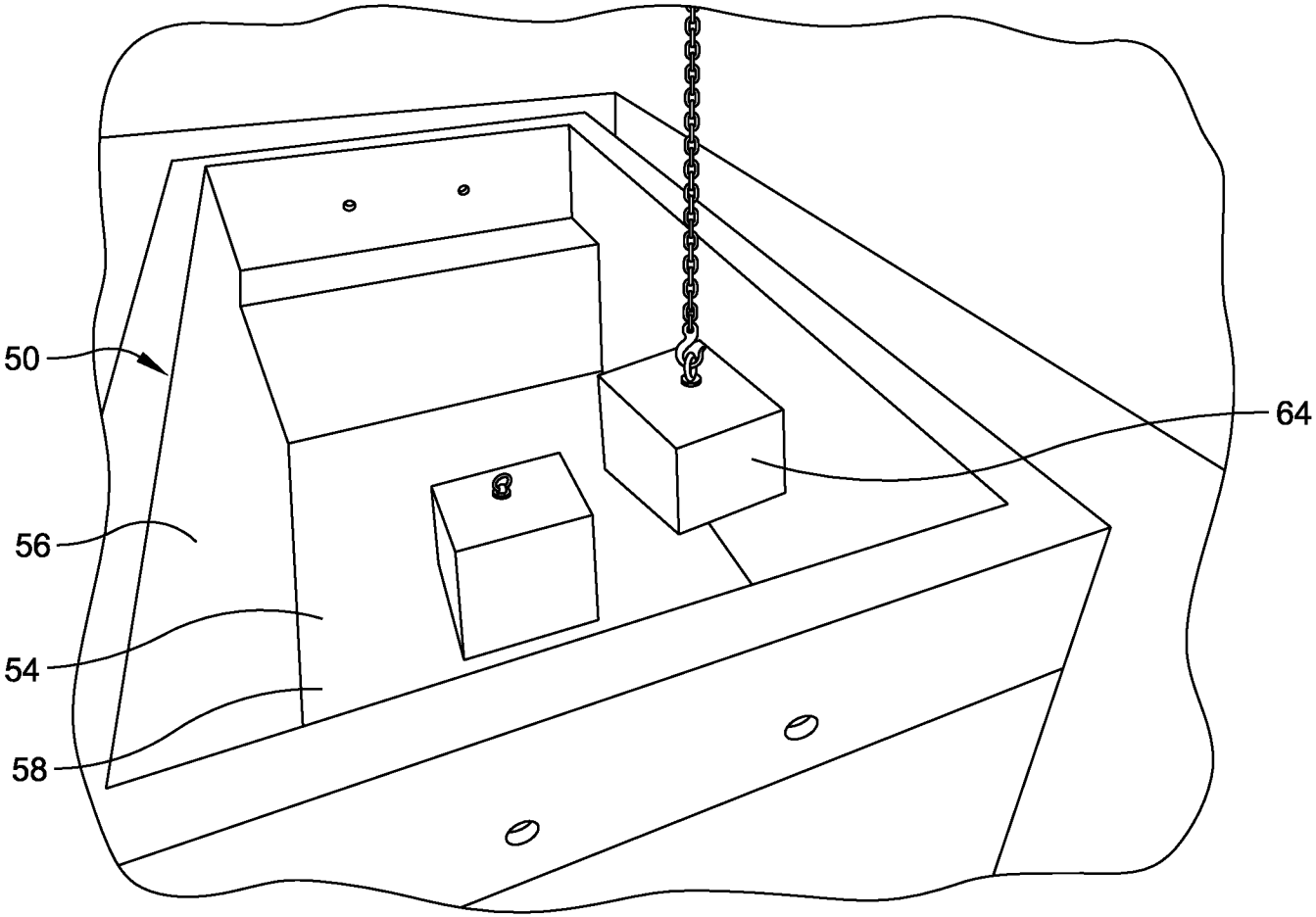
FIG. 11 is another view of a step of assembling the modular pool of FIG. 6.
Figure 12:
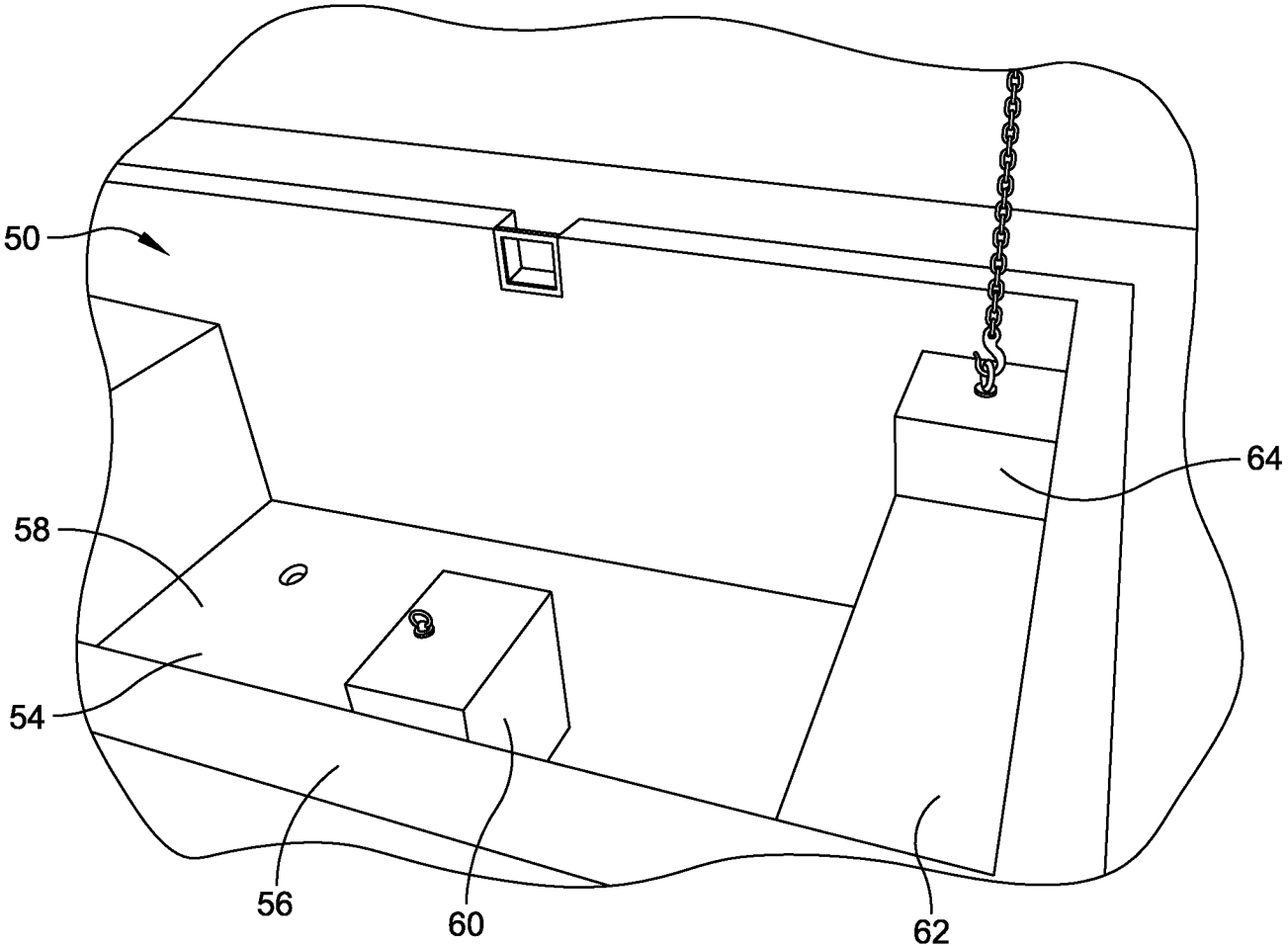
FIG. 12 is another view of a step of assembling the modular pool of FIG. 6.
Figure 13:
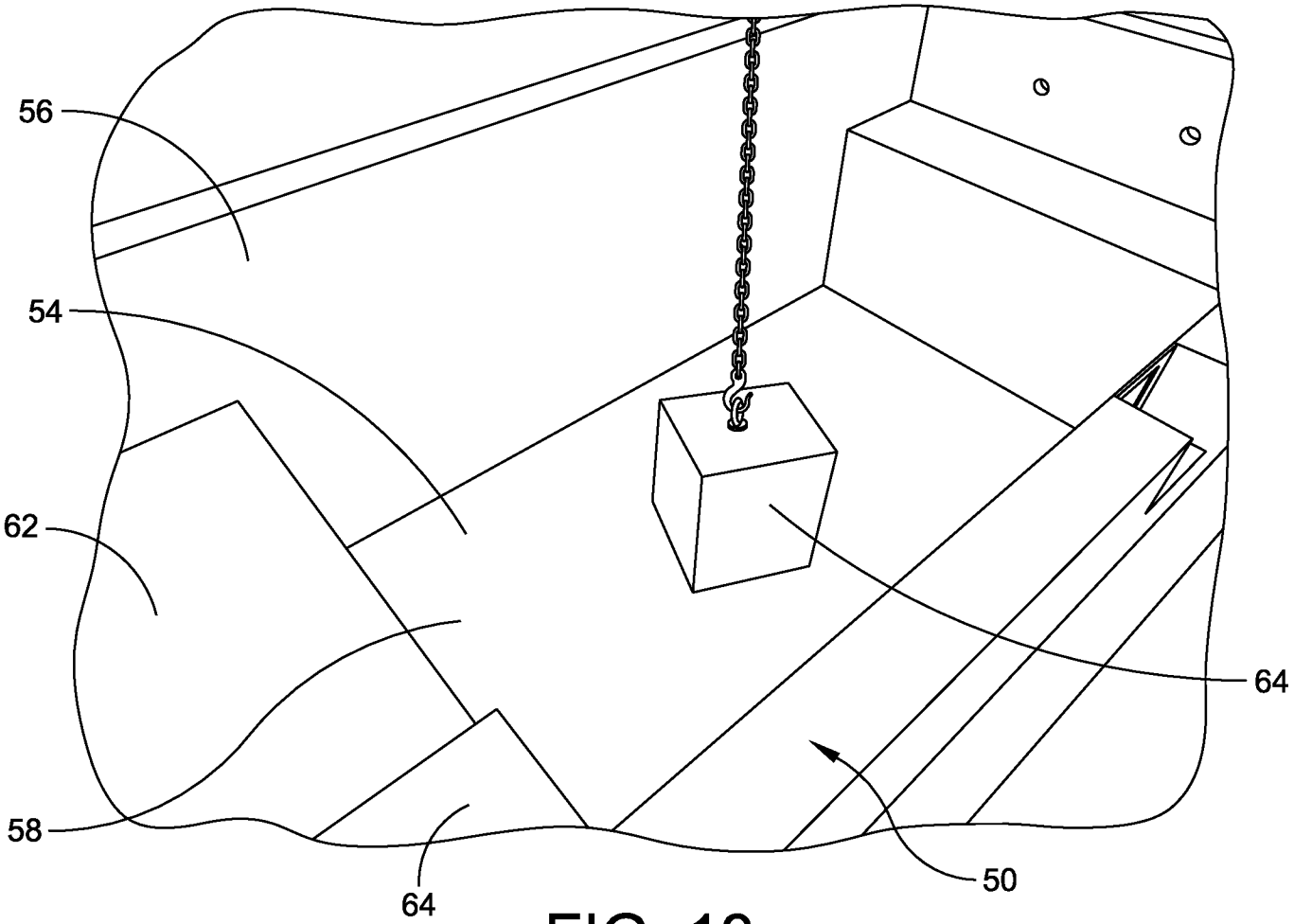
FIG. 13 is another view of a step of assembling the modular pool of FIG. 6.
Figure 14:
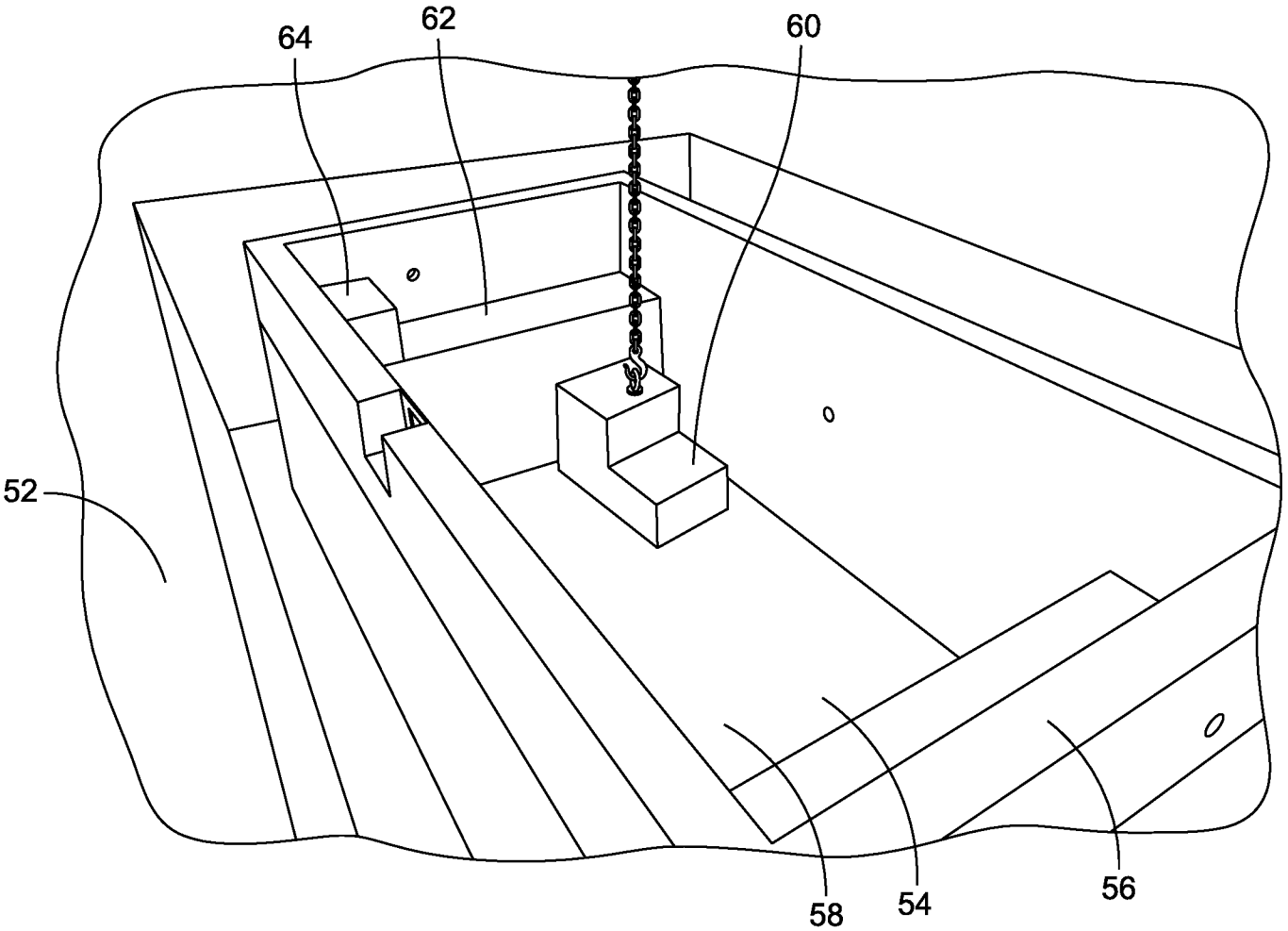
FIG. 14 is another view of a step of assembling the modular pool of FIG. 6.
Figure 15C:
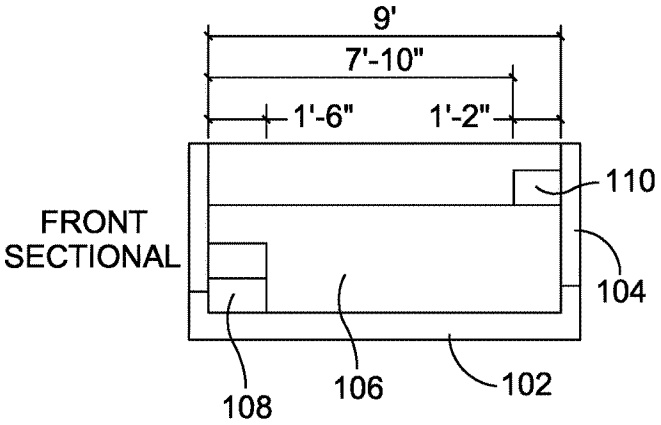
FIG. 15C is a front view of an embodiment of the modular pool of FIG. 15A.
Figure 15D:
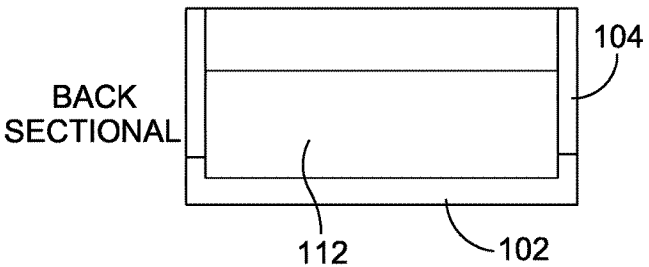
FIG. 15D is a back view of an embodiment of the modular pool of FIG. 15A.
Figure 15A:
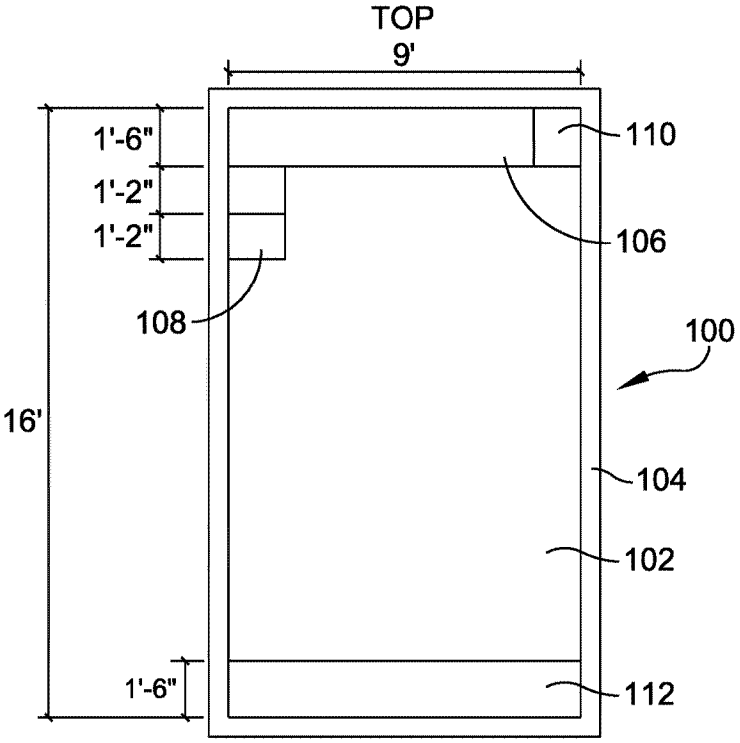
FIG. 15A is a top view of an embodiment of a modular pool according to the present disclosure.
Figure 15B:
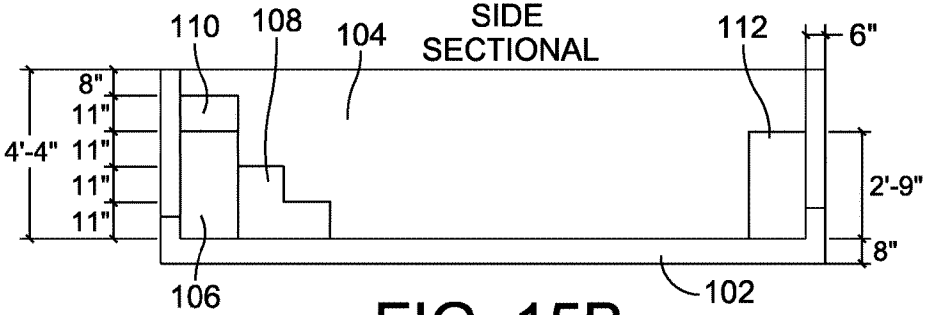
FIG. 15B is a side view of an embodiment of the modular pool of FIG. 15A.

FIGS. 8 and 9 show the riser unit 56 in place on the base unit 54. In FIGS. 8 and 9, the bench unit 62 is repositioned by the crane and again lowered onto the base unit 54 so the bench unit 62 rests on the upper surface 58 of the base unit. In FIGS. 10-12, mortar is applied to the top step 64, and the top step 64 is moved into place on the bench 60. When the mortar dries, the mortar secures the top step 64 to the bench 62. In FIGS. 13 and 14, mortar is applied to the bottom step riser, and the bottom step 60 is moved into place on the upper surface of the base unit adjacent the bench. When the mortar dries, the mortar secures the bottom step 60 to the upper surface 58 of the base unit 54. In some embodiments, operators apply mortar to the precast bench 62, the top step 64, and the bottom step 60 and move them into place within the modular pool 50 within 15 minutes. The installation time is much shorter than for similarly sized prior art pools. The decreased installation time enables a significantly decreased labor cost associated with installation of the modular pool 50 relative to prior art pools.

Embodiments of modular pools of the present disclosure can be made with various dimensions. FIGS. 15A-15D are blueprints showing a top view, a side view, a front view, and a back view for a modular pool 100 having an internal recess that is 16 feet long by 9 feet wide. The modular pool 100 includes a base unit 102, a riser unit 104, a first bench 106, a bottom step 108, and a top step 110, and a second bench 112. The base unit 102, the riser unit 104, the first bench 106, the bottom step 108, the top step 110, and the second bench 112 are all delivered to an installation site as precast concrete components.

FIG. 16A-16E is another set of blueprints showing the components of the modular pool 100 of FIG. 15.

The base unit 102 is configured to support the riser unit 104. The base unit 102 includes a bottom wall 116 and a relatively short side wall 118 extending upwardly from a perimeter of the bottom wall 116. As shown in FIG. 16A-16E, the bottom wall 116 and the side wall 118 of the base unit 102 are made of precast concrete and include rebar to reinforce the concrete. The bottom wall 116 includes a lower surface 120 that is configured to sit on a ground surface, such as a recessed surface in the ground at an installation site. The bottom wall 116 includes an upper surface 122 that is configured to support internal modular units and/or a pool liner. For example, the pool liner can be secured to the upper surface 122 by an adhesive.

Figure 16F:
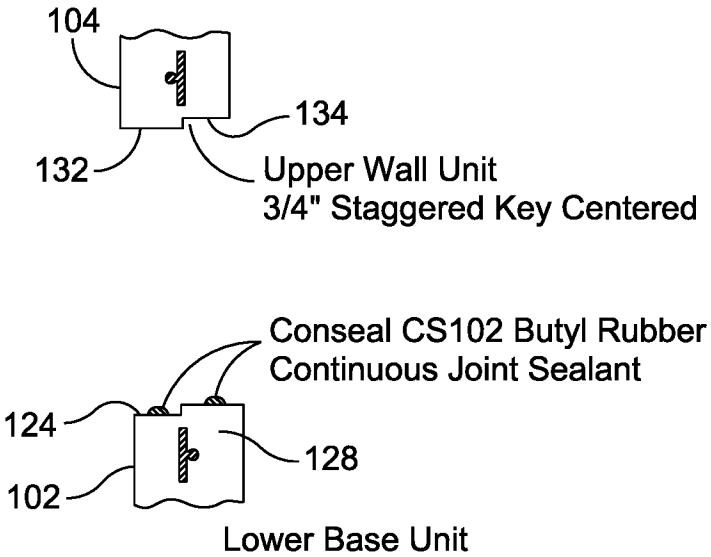
FIG. 16F is a partial cross sectional view of the base unit and the riser unit of the modular pool of FIG. 16A-16E.

The side wall 118 is configured to facilitate alignment of the base unit 102 with the riser unit 104. As shown in FIG. 16F, an upper surface 124 of the side wall of the base unit includes a stepped surface 128 that is configured to engage and align with a corresponding recess on mating stepped surface on a lower end of the riser unit 104. As shown in FIG. 16F, the height of the stepped surface 128 is 0.75 inch.

The riser unit 104 is configured to be lowered onto the base unit 102 and secured in place with respect to the base unit 102 so that the base unit 102 and the riser unit 104 together define a reservoir for containing water for swimming. The riser unit 104 is made of precast concrete and includes rebar to reinforce the concrete. The riser unit 104 includes four side wall portions 130 that are connected at four corners. The four side wall portions 130 of the riser unit 104 extend from an upper end of the riser unit that defines an open upper end of the pool to a lower end of the riser unit that is configured to be seated on the base unit 102.

A stepped surface 132 of the riser unit 104 is configured to facilitate alignment of the riser unit 104 with respect to the base unit 102. As shown in FIG. 16F, the stepped surface 132 of the riser unit 104 includes a recess 134 that is configured to engage and align with the corresponding stepped surface 128 on the upper surface of the base unit. As shown in FIG. 16F, the depth of the recess 134 is 0.75 inch.

The riser unit 104 includes an external surface 142 that is configured to be placed within a hole in the ground and an internal 144 surface that faces the interior volume of the pool structure. The internal surface 144 is configured to engage and/or support the pool liner. For example, the pool liner can be secured to the internal surface 144 by an adhesive.

The base unit 102 and the riser unit 104 can have dimensions other than those shown in FIGS. 16A-16F.

Figure 17:
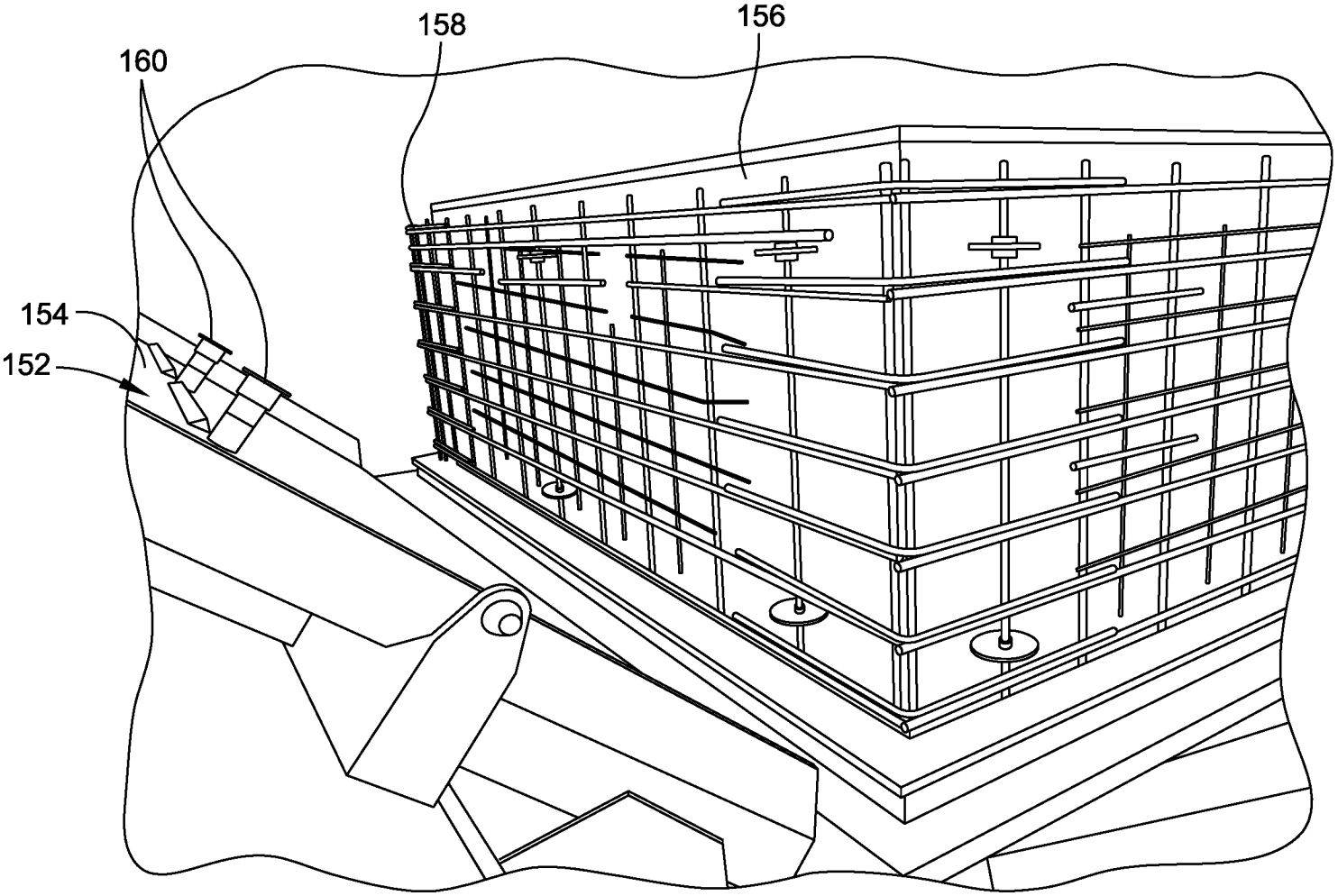
FIG. 17 is a perspective view of a preform and rebar for forming a riser unit according to the present disclosure.
Figure 18:
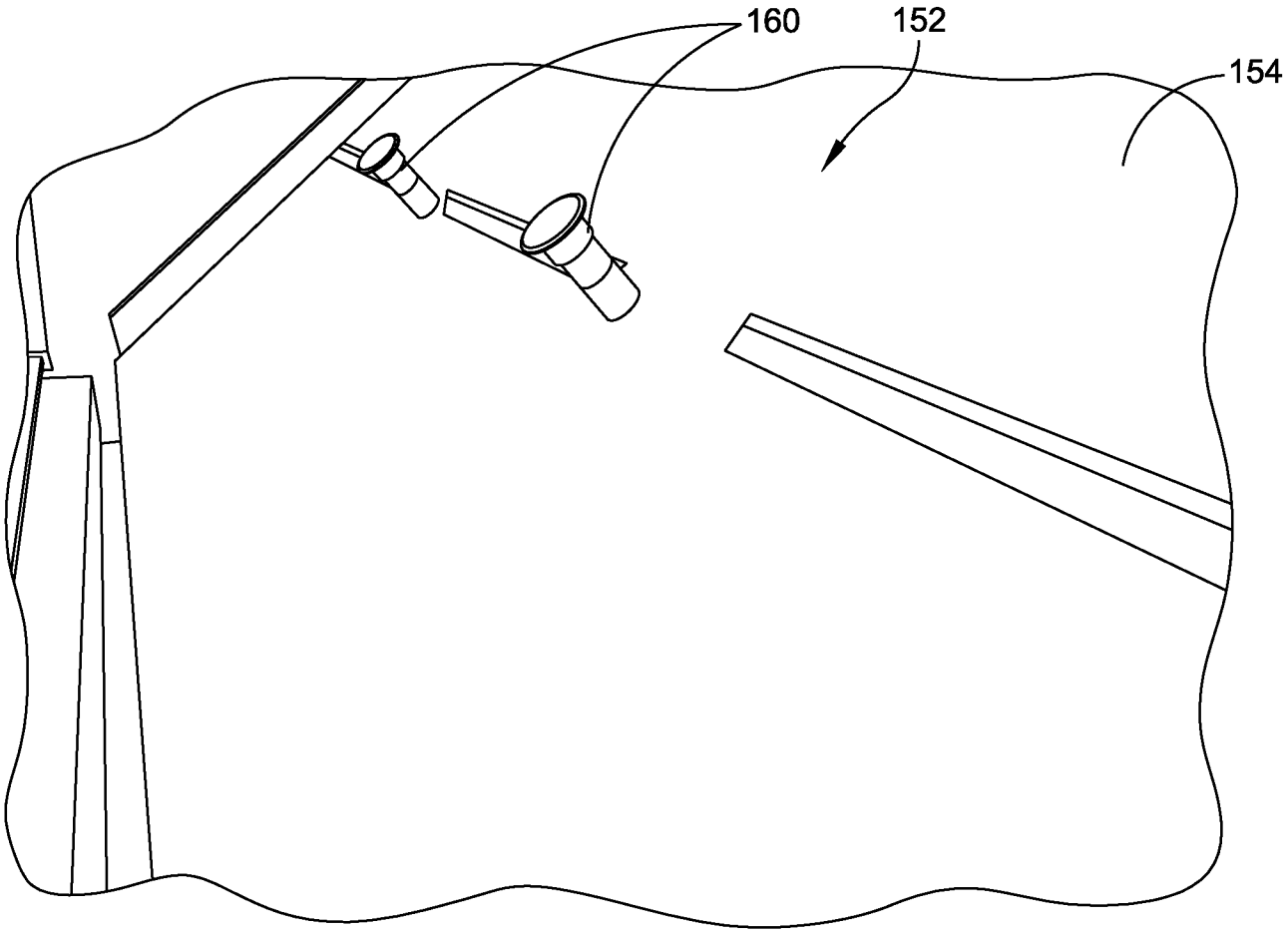
FIG. 18 is another perspective view of the preform of FIG. 17.
Figure 19:
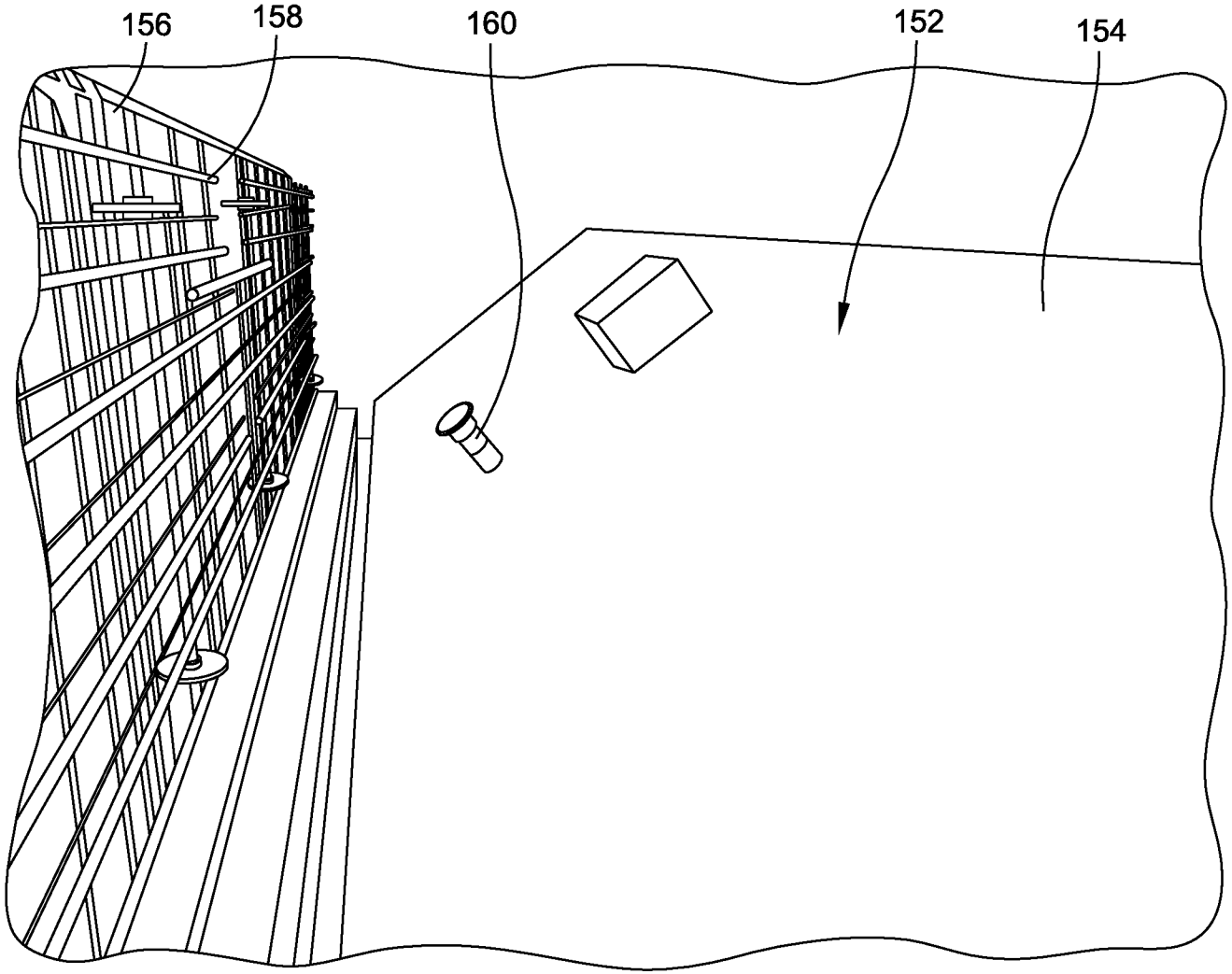
FIG. 19 is another perspective view of the preform of FIG. 17.

FIGS. 17-19 show a concrete preform, indicated generally at 152, that can be used for pouring concrete to form a riser unit according to the present disclosure. The preform 152 includes an outer portion 154 and an inner portion 156. In FIG. 17, rebar 158 is arranged around the inner portion 156 of the preform 152. In some embodiments, the rebar 158 is held in tension prior to pouring concrete into the preform 152. When the inner portion 156 of the preform 152 1 is moved into place around the rebar 158, concrete is poured into the interior space of the preform to cast the riser unit.

One or more blanks may be used to define one or more ports in the riser unit. Posts 160 extend from the outer portion 154 of the preform 152 towards the inner portion 156 of the preform 152. The posts 160 are blanks that are provided to define ports in the form of channels in the riser unit. The channels are useful as water inlets and/or water outlets. The channels can be connected to external piping that is in fluid communication with a water pump to move water through the channels. A protrusion 162 extends from the outer portion 154 of the preform 152 to define a skimmer port 164 in one of the walls of the riser unit.

Figure 20:
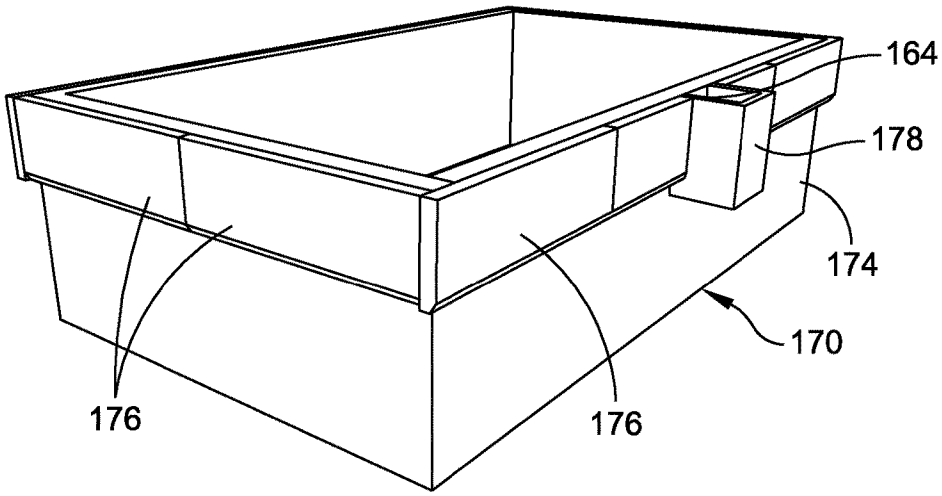
FIG. 20 is a perspective view of a portion of another embodiment of a modular pool according to the present disclosure.
Figure 21:
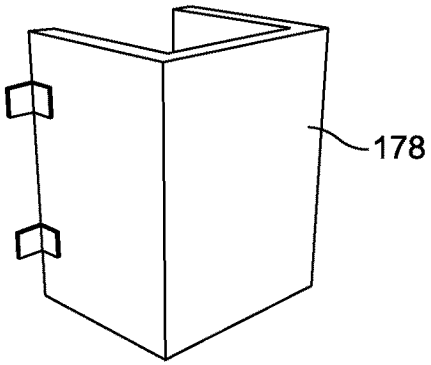
FIG. 21 is a perspective view of a skimmer panel of the modular pool of FIG. 20.
Figure 22A:
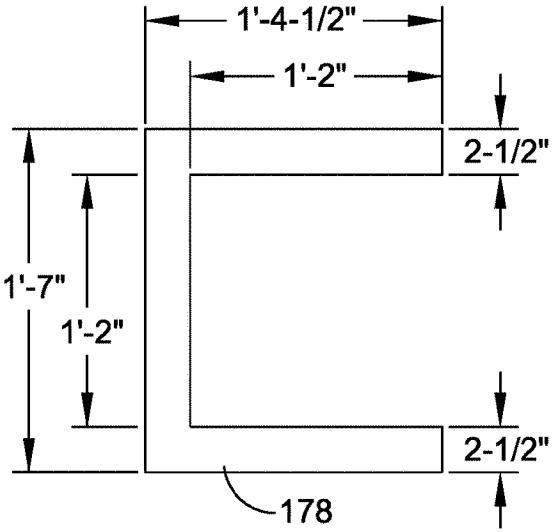
FIGS. 22A-22B is a set of blueprints for the skimmer panel of FIG. 21.
Figure 22B:
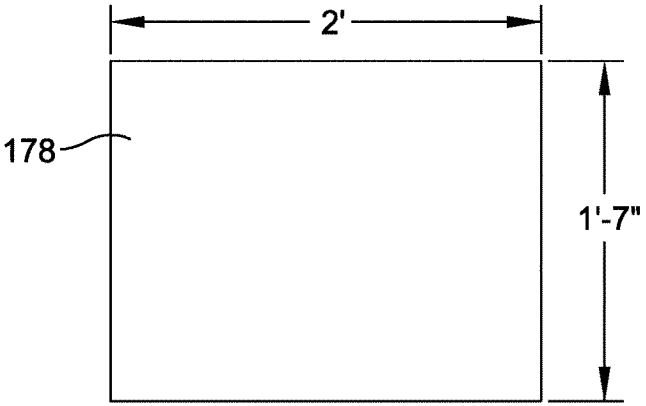

FIG. 20 shows a perspective view of an embodiment of a modular pool, indicated generally at 170, including a base unit (not shown), a riser unit 174, precast exterior wall panels 176 secured to the riser unit 174 and an external skimmer panel 178 that is secured to the riser unit 174. In some embodiments, stone veneer is attached the precast exterior wall panels. The precast skimmer panel 178 is shown separately in FIG. 21 and can be secured to an external surface of the riser unit around a skimmer port defined in the riser unit 174. FIGS. 22A and 22B show exemplary dimensions for the skimmer panel 178.

Figure 23B:
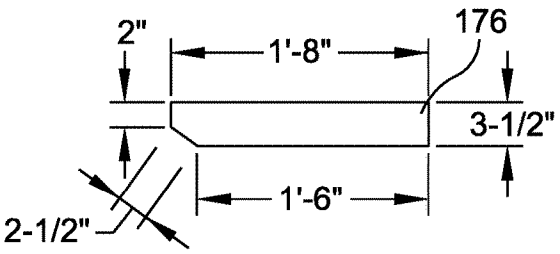
FIGS. 23A-23B is a set of blueprints for an exterior wall panel of the modular pool of FIG. 20.
Figure 23A:
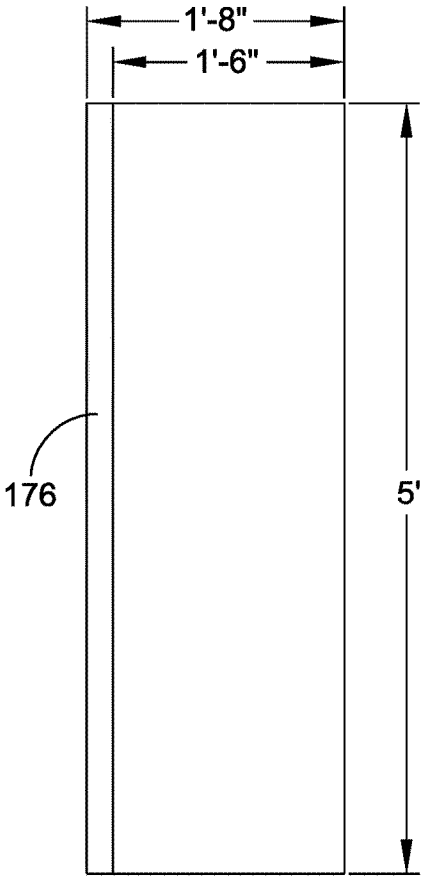

The precast exterior wall panels 172 can be secured to the external surface of the riser unit 174 after the riser unit 174 is moved into place on the base unit in the recess in the ground at the installation site. The precast exterior wall panels 172 eliminate the need to "pad out" the exterior wall of the riser unit 174 at the installation site, which would be needed when the upper end of the modular pool extends above the ground by 16 inches to 18 inches. In some embodiments, stone veneer is applied to the panels offsite, further reducing the amount of work needed at the installation site. FIGS. 23A and 22B show exemplary dimensions for the precast exterior wall panel.

FIGS. 24-28 show exemplary embodiments of internal modular units that can be placed in within the interior volume defined by the base unit and the riser unit. The internal modular units are precast and can be arranged within the interior volume of the pool structure as desired by a user. The internal modular units can sit directly on the upper surface of the base unit and/or on top of other internal modular units. In some embodiments, the internal modular units can be secured to the upper surface of the base unit. For example, in some embodiments, the internal modular units are secured to the upper surface of the base unit by mortar.

Figure 27:
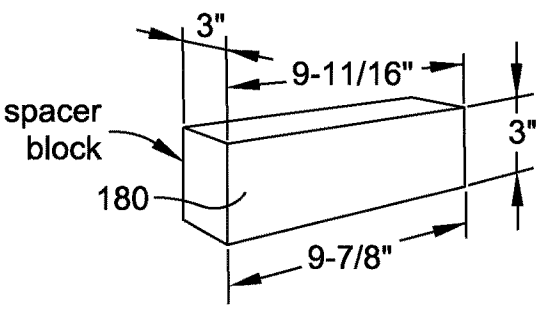
FIG. 27 is a perspective view of a spacer block of the bench of FIG. 26.
Figure 26:
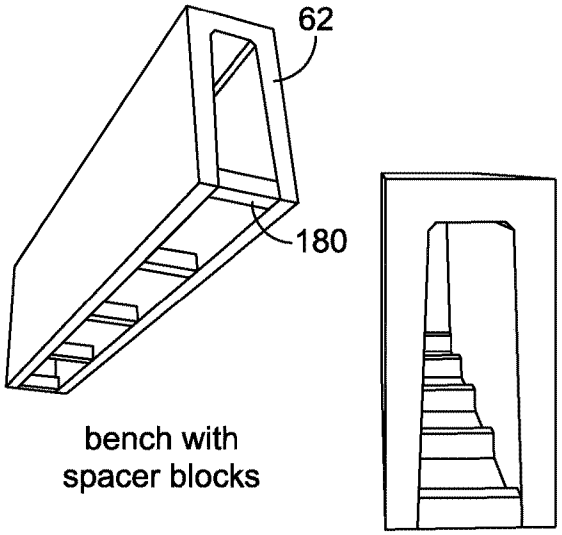
FIG. 26 is a perspective view of the bench of the modular pool of FIG. 6.
Figure 24:
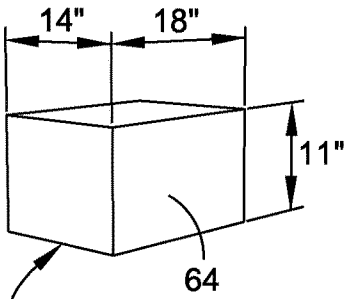
FIG. 24 is a perspective view of the top step of the modular pool of FIG. 6.
Figure 25:
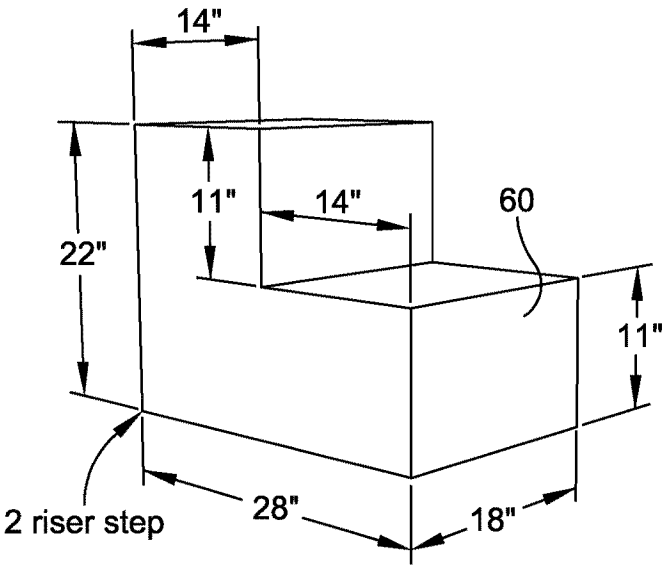
FIG. 25 is a perspective view of the bottom step of the modular pool of FIG. 6.
Figure 28B:
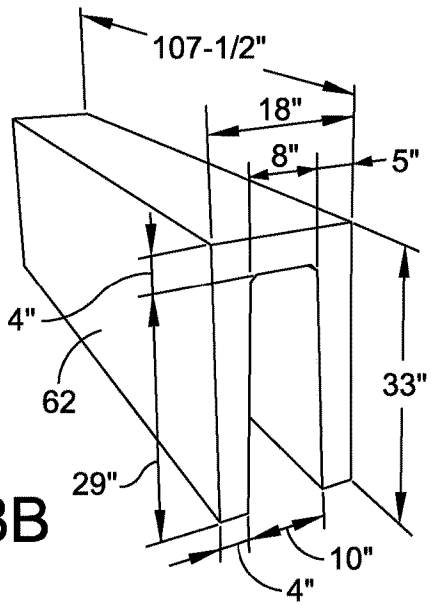
FIG. 28A-28E is a set of blueprints for forming the bench of FIG. 26.
Figure 28A:
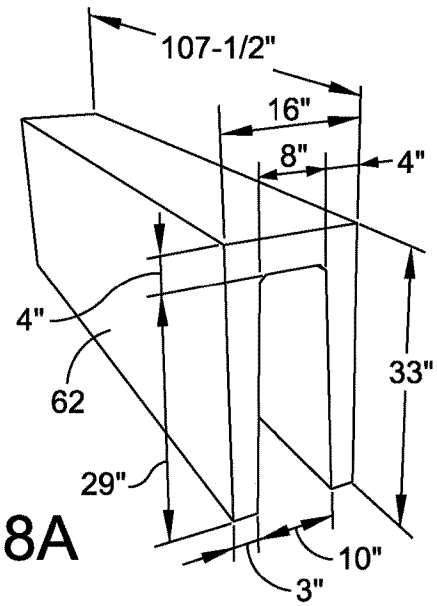
Figure 28E:
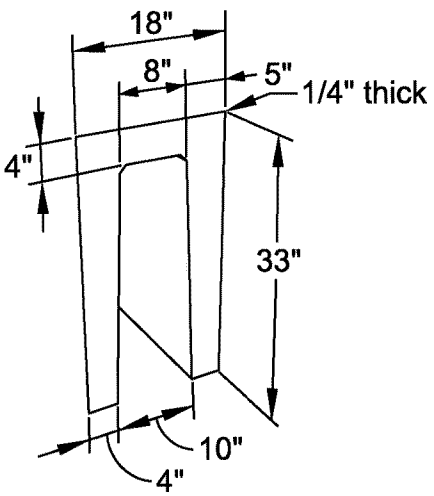
Figure 28D:
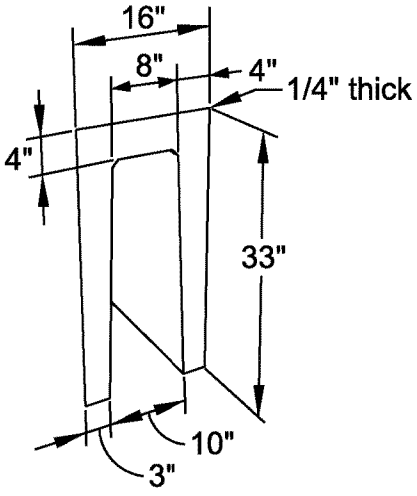
Figure 28C:
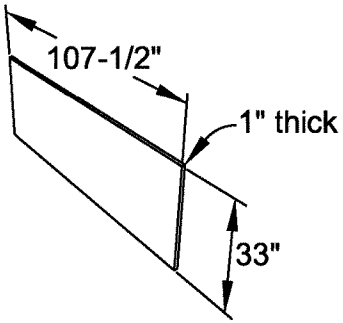

In particular, FIG. 24 shows exemplary dimensions of the upper step 64 of FIG. 6. FIG. 25 shows exemplary dimensions of the bottom step 60 of FIG. 6. FIG. 26 shows a lower perspective view of the bench 62 of FIG. 6. The bench 62 includes spacer blocks 180 to provide structural support for a hollow body of the bench 62. One of the spacer blocks 180 is shown in FIG. 27. Exemplary dimensions of the bench 62 are shown in FIGS. 28A-28E.

One or more benches or other modular platforms can be positioned in the pool to achieve desired internal features in the pool. For example, the height of the bench can be selected to create a shallow area in the pool that can be used as a built in lounge area, an area for sunning, or an area for small children to play in shallow water. In some embodiments, the bench is it is wider and taller than the bench shown in FIG. 26.

Figure 29:
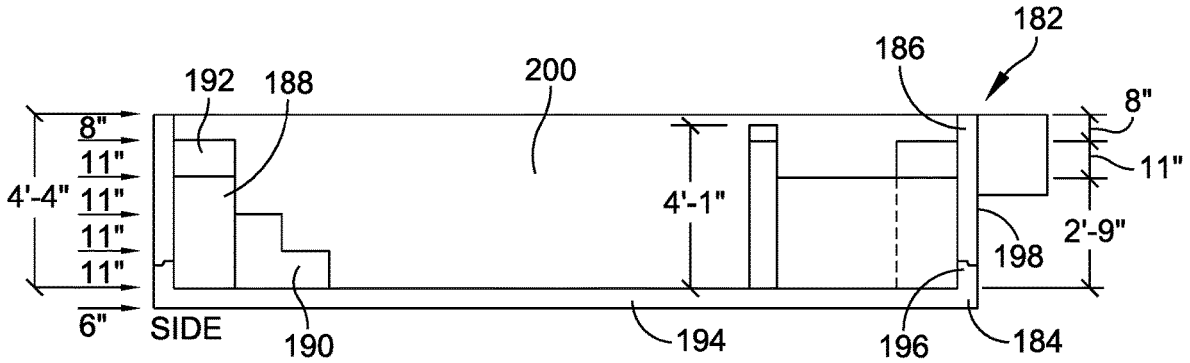
FIG. 29 is a cross sectional view of another embodiment of a modular pool according to the present disclosure.
Figure 30:
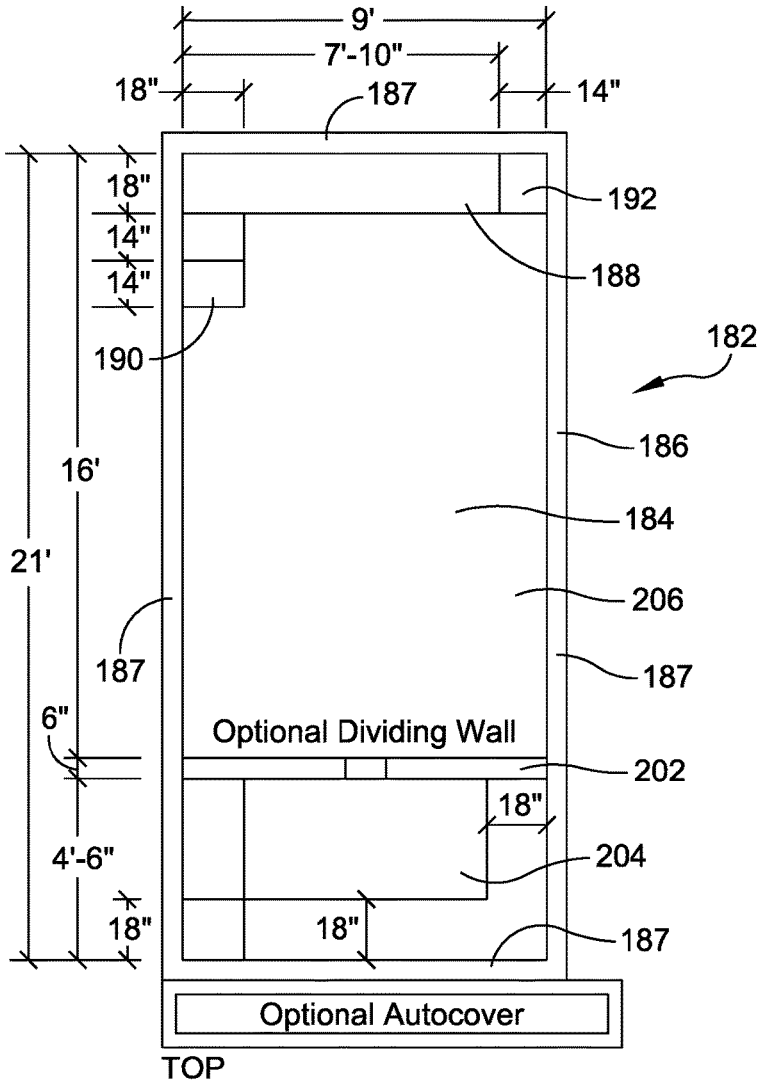
FIG. 30 is a top view of the embodiment of FIG. 29.

FIGS. 29 and 30 show another embodiment of a modular pool according to the present disclosure, generally indicated at 182.

The modular pool 182 includes a base unit 184, a riser unit 186, a bench 188, a bottom step 190, and a top step 192. The base unit 184, the riser unit 186, the bench 188, the bottom step 190, and the top step 192 are all delivered to an installation site as precast concrete components.

The base unit 184 is configured to support the riser unit 186. The base unit 184 includes a bottom wall 194 and a relatively short side wall 196 extending upwardly from a perimeter of the bottom wall 194. The bottom wall 194 and the side wall 196 of the base unit 184 are made of precast concrete and, in some embodiments, include rebar to reinforce the concrete. The bottom wall 194 includes a lower surface that is configured to sit on a ground surface, such as a recessed surface in the ground at an installation site. The bottom wall 194 includes an upper surface that is configured to support internal modular units and/or a pool liner. For example, the pool liner can be secured to the upper surface by an adhesive.

The side wall 196 is configured to facilitate alignment of the base unit 184 with the riser unit 186. As shown in FIG. 29, an upper surface of the side wall 196 of the base unit includes a stepped surface that is configured to engage and align with a corresponding recess on a mating stepped surface on a lower end of the riser unit 186. This stepped surface and recess are similar to the stepped surface and recess of the embodiment of FIG. 16F.

The riser unit 186 is configured to be lowered onto the base unit 184 and secured in place with respect to the base unit 184 so that the base unit 184 and the riser unit 186 together define a reservoir for containing water for swimming. The riser unit 186 is made of precast concrete and includes rebar to reinforce the concrete. The riser unit 186 includes four side wall portions 187 that are connected at four corners. The four side wall portions of the riser unit 186 extend from an upper end of the riser unit that defines an open upper end of the pool to a lower end of the riser unit that is configured to be seated on the base unit 184.

A stepped surface of the riser unit 186 is configured to facilitate alignment of the riser unit 186 with respect to the base unit 184. The stepped surface of the riser unit 186 includes a recess that is configured to engage and align with the corresponding stepped surface on the upper surface of the base unit. This recess and stepped surface are similar to the recess and stepped surface of the embodiment of FIG. 16F.

The riser unit 186 includes an external surface 198 that is configured to be placed within a hole in the ground and an internal surface 200 that faces the interior volume of the pool structure. The internal surface 200 is configured to engage and/or support the pool liner. For example, the pool liner can be secured to the internal surface 200 by an adhesive.

A partition 202 extends from the internal surface 200 on one of the side walls 187 to an opposite one of the side walls 187 as shown in the top view of FIG. 30. The partition has a lower end that is configured to engage the upper surface of the bottom wall 194 of the base unit 184. In some embodiments, the lower end of the partition 202 is secured to the bottom wall 194 by mortar. In some embodiments, a liner or another material is placed over the partition 202.

The partition 202 is formed of precast concrete and is integral with the side walls 187 of the riser unit 186.

The partition 202 divides the interior volume of the pool structure into a first region 204 and a second region 206. In some embodiments, the first region 204 and the second region 206 are used to contain water at different temperatures. In some embodiments, the first region 204 is used as a hot tub, and the second region 206 is used as a swimming pool.

In various embodiments, the placement of the partition 202 is selected to provide the desired internal dimensions of the first region 204 and the second region 206. As shown in FIG. 30, the first region 204 has an internal area of 4.5 feet by 9 feet, when viewed from above, and the second region 206 has an internal area of 16 feet by 9 feet when viewed from above.

One or more precast internal structures may be placed within the first region 204, just as the bench 188, the bottom step 190, and the top step 192 are shown placed within the second region 206.

FIGS. 31-34 show another embodiment of a modular pool according to the present disclosure, generally indicated at 300.

The modular pool 300 includes a base unit 304, a riser unit 306, a bench 308, a bottom step 310, and a top step 312. The base unit 304, the riser unit 306, the bench 308, the bottom step 310, and the top step 312 are all delivered to an installation site as precast concrete components.

The base unit 304 is configured to support the riser unit 306. The base unit 304 includes a bottom wall 314 and a relatively short side wall 316 extending upwardly from a perimeter of the bottom wall 314. The bottom wall 314 and the side wall 316 of the base unit 304 are made of precast concrete and, in some embodiments, include rebar to reinforce the concrete. The bottom wall 314 includes a lower surface that is configured to sit on a ground surface, such as a recessed surface in the ground at an installation site. The bottom wall 314 includes an upper surface that is configured to support internal modular units and/or a pool liner. For example, the pool liner can be secured to the upper surface by an adhesive.

The side wall 316 is configured to facilitate alignment of the base unit 314 with the riser unit 316. An upper surface of the side wall 316 of the base unit includes a stepped surface that is configured to engage and align with a mating stepped surface on a lower end of the riser unit 306. This stepped surface and recess are similar to the stepped surface and recess of the embodiment of FIG. 16F.

The riser unit 306 is configured to be lowered onto the base unit 304 and secured in place with respect to the base unit 304 so that the base unit 304 and the riser unit 306 together define a reservoir for containing water for swimming. The riser unit 306 is made of precast concrete and includes rebar to reinforce the concrete. The riser unit 306 includes four side wall portions 318 that are connected at four corners. The four side wall portions of the riser unit 306 extend from an upper end of the riser unit that defines an open upper end of the pool to a lower end of the riser unit that is configured to be seated on the base unit 304.

A stepped surface of the riser unit 306 is configured to facilitate alignment of the riser unit 306 with respect to the base unit 304. The stepped surface of the riser unit 306 includes a recess that is configured to engage and align with the corresponding stepped surface on the upper surface of the base unit. This recess and stepped surface are similar to the recess and stepped surface of the embodiment of FIG. 16F.

The riser unit 306 includes an external surface 320 that is configured to be placed within a hole in the ground and an internal surface 322 that faces the interior volume of the pool structure. The internal surface 322 is configured to engage and/or support the pool liner. For example, the pool liner can be secured to the internal surface 322 by an adhesive.

Figure 31:
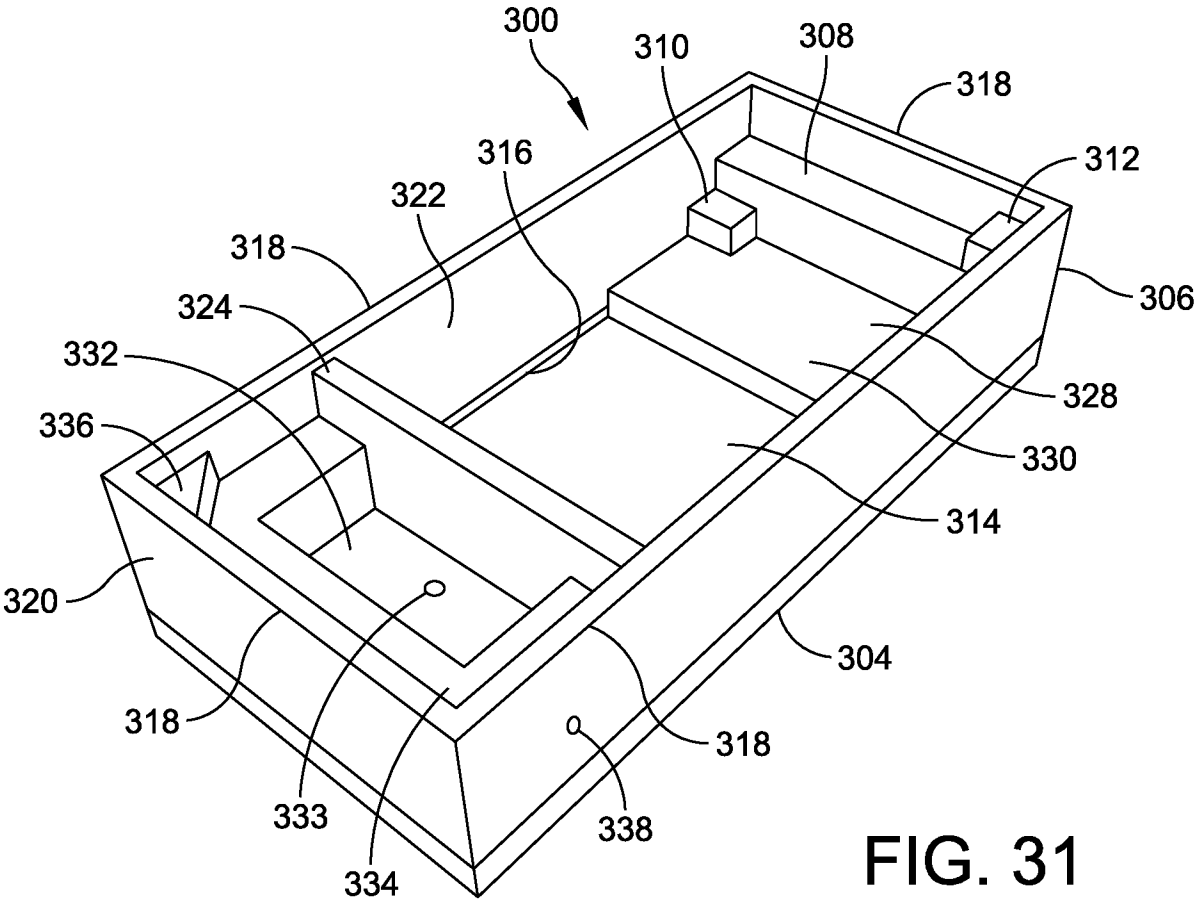
FIG. 31 is a perspective view of another embodiment of a modular pool according to the present disclosure.
Figure 32:
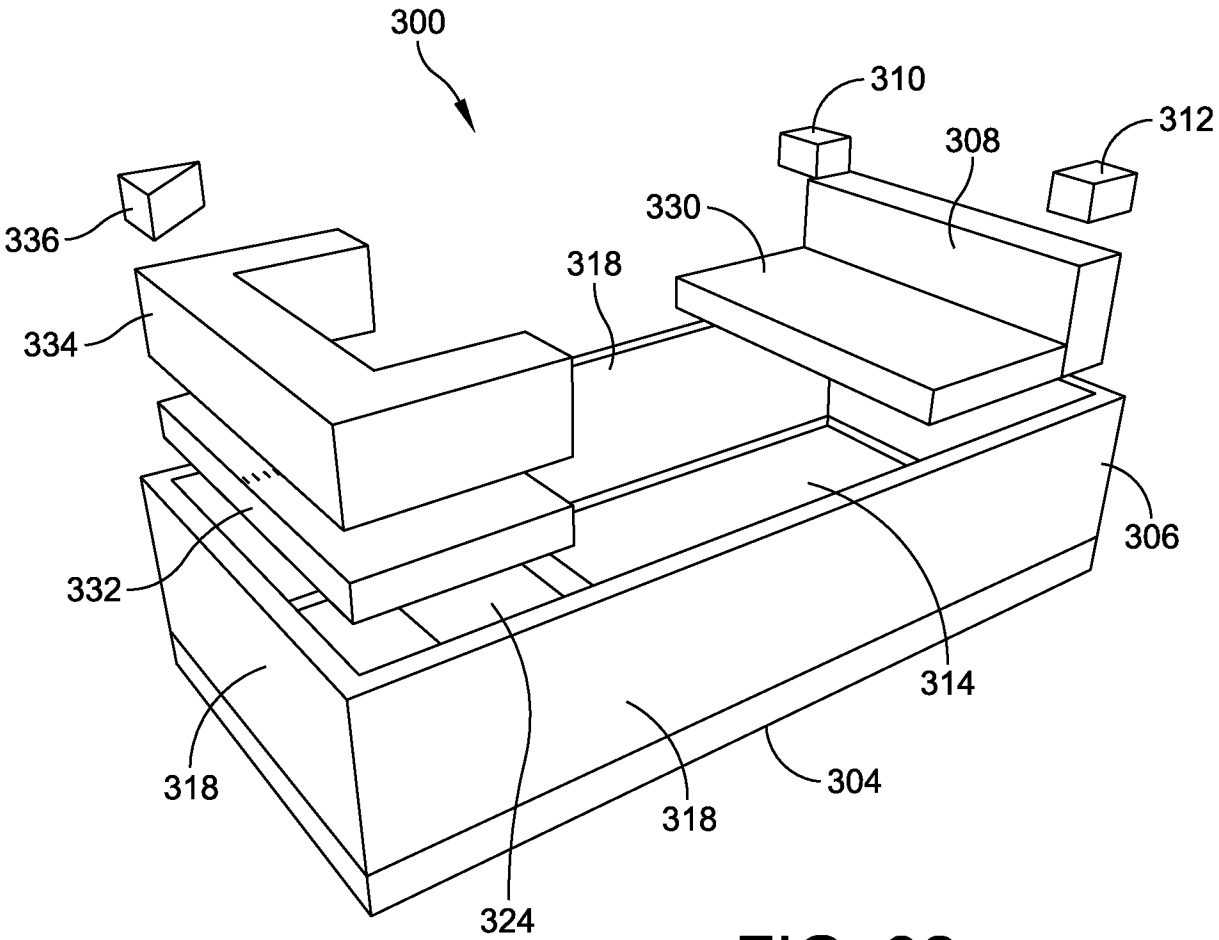
FIG. 32 is an exploded view thereof.

A partition 324 extends from the internal surface 322 on one of the side walls 318 to an opposite one of the side walls 318 as shown in the top view of FIG. 31. The partition has a lower end that is configured to engage the upper surface of the bottom wall 314 of the base unit 304. In some embodiments, the lower end of the partition 324 is secured to the bottom wall 314 by mortar. In some embodiments, a liner or another material is placed over the partition 324.

The partition 324 is formed of precast concrete. In some embodiments, the partition 324 and is integral with the side walls 318 of the riser unit 306.

The partition 324 divides the interior volume of the pool structure into a first region 326 and a second region 328. In some embodiments, the first region 326 and the second region 328 are used to contain water at different temperatures. In some embodiments, the first region 326 is used as a hot tub, and the second region 328 is used as a swimming pool.

Figure 33:
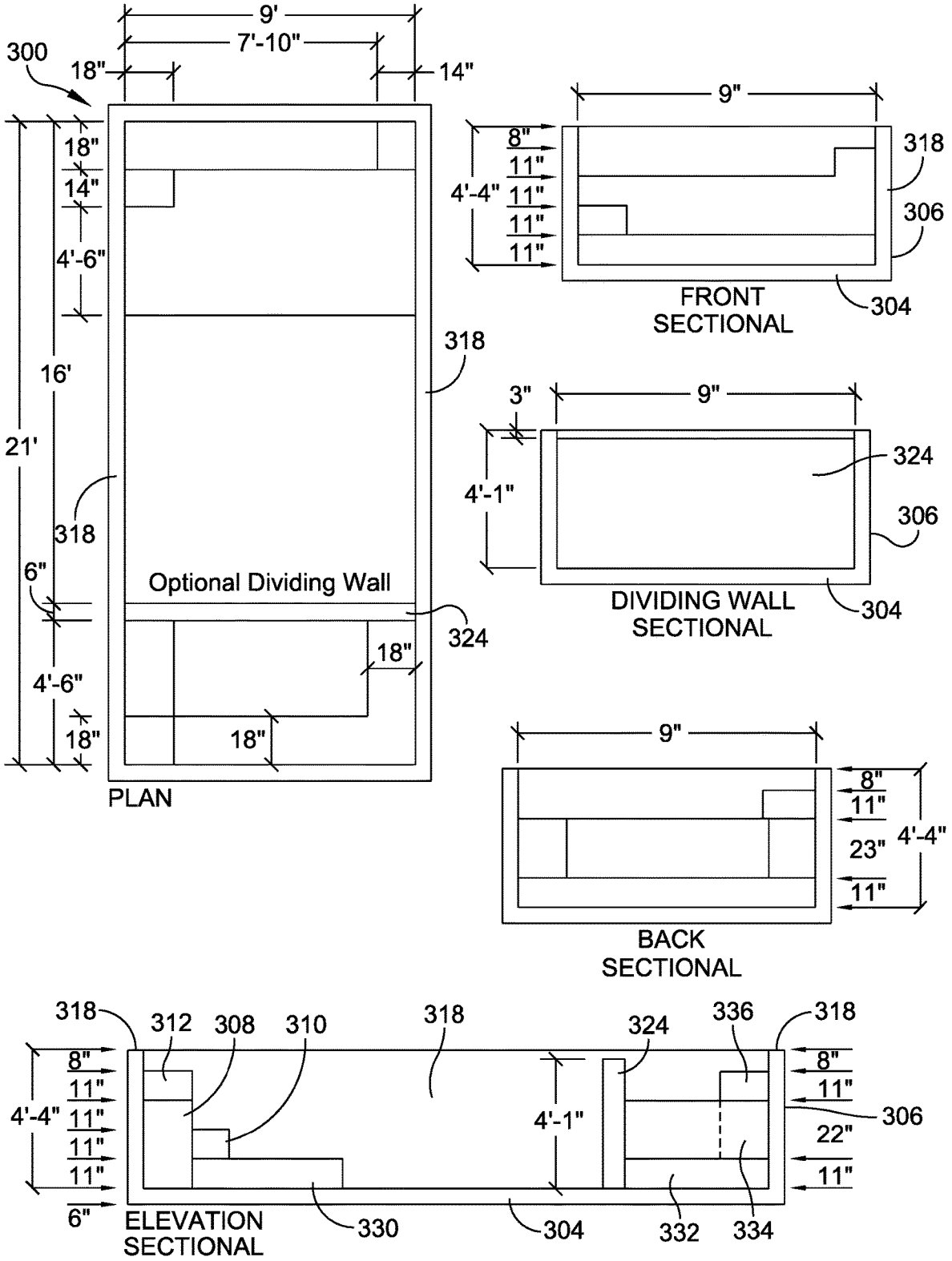
FIG. 33 is a set of schematic views thereof.
Figure 34:
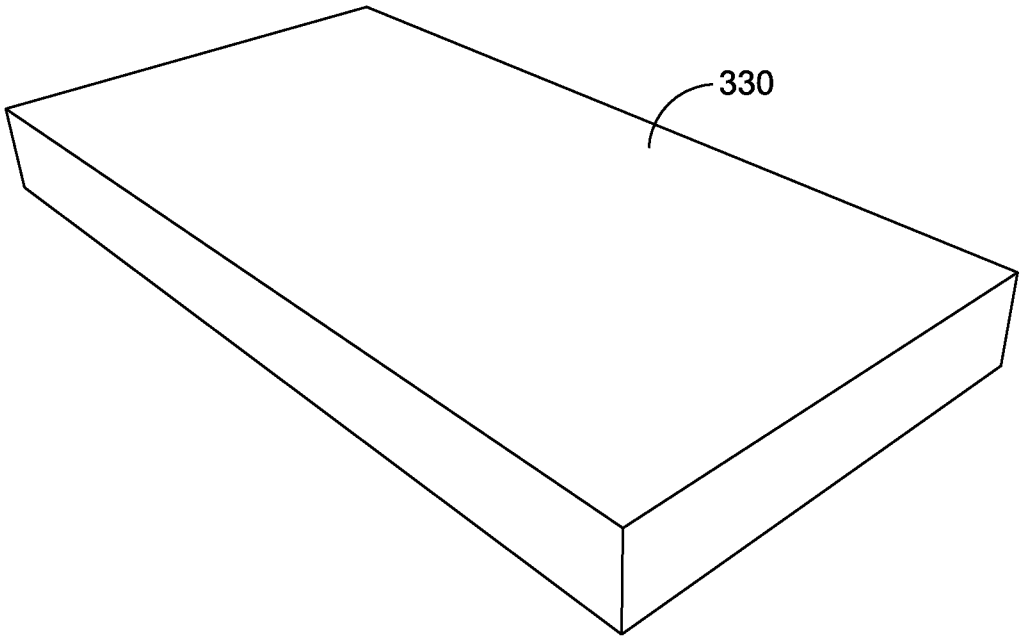
FIG. 34 is a perspective view of a platform used in the modular pool of FIG. 31.

In various embodiments, the placement of the partition 324 is selected to provide the desired internal dimensions of the first region 326 and the second region 328. As shown in FIG. 33, the first region 326 has an internal area of 4.5 feet by 9 feet, when viewed from above, and the second region 328 has an internal area of 16 feet by 9 feet when viewed from above.

One or more precast internal structures may be placed within the first region 326, just as the bench 308, the bottom step 310, and the top step 312 are shown placed within the second region 328. The embodiment of FIG. 31 includes a platform 330 (FIG. 34) positioned adjacent to the bench 308. Positioning the platform 330 adjacent the bench yields a shallow portion of the second region 328, which may be beneficial to shorter individuals using the modular pool 300. In some embodiments, the platform 330 is a 4.5'×9'×11" slab that is made of precast concrete. In some embodiments, the water level above the platform is 37 inches deep.

Similarly, one or more precast internal structures may be placed within the second region 328. The embodiment of FIG. 31 includes a second platform 332 placed over the base unit 314 and a second bench 334 placed on top of the second platform 332. A third step 336 is seated on an upper face of the second bench 334.

The platform 332 includes a drain hole 333 in communication with a channel defined in the platform. When the platform 332 is lowered into the onto the bottom wall 314, crewmembers installing the pool 300 make a pipe connection at a port 338 defined in one of the walls 318 that is aligned with the channel of the platform. Then the crewmembers lower the second bench 334 into place. The precast drain hole saves time in installation of the pool 300.

Figure 35:
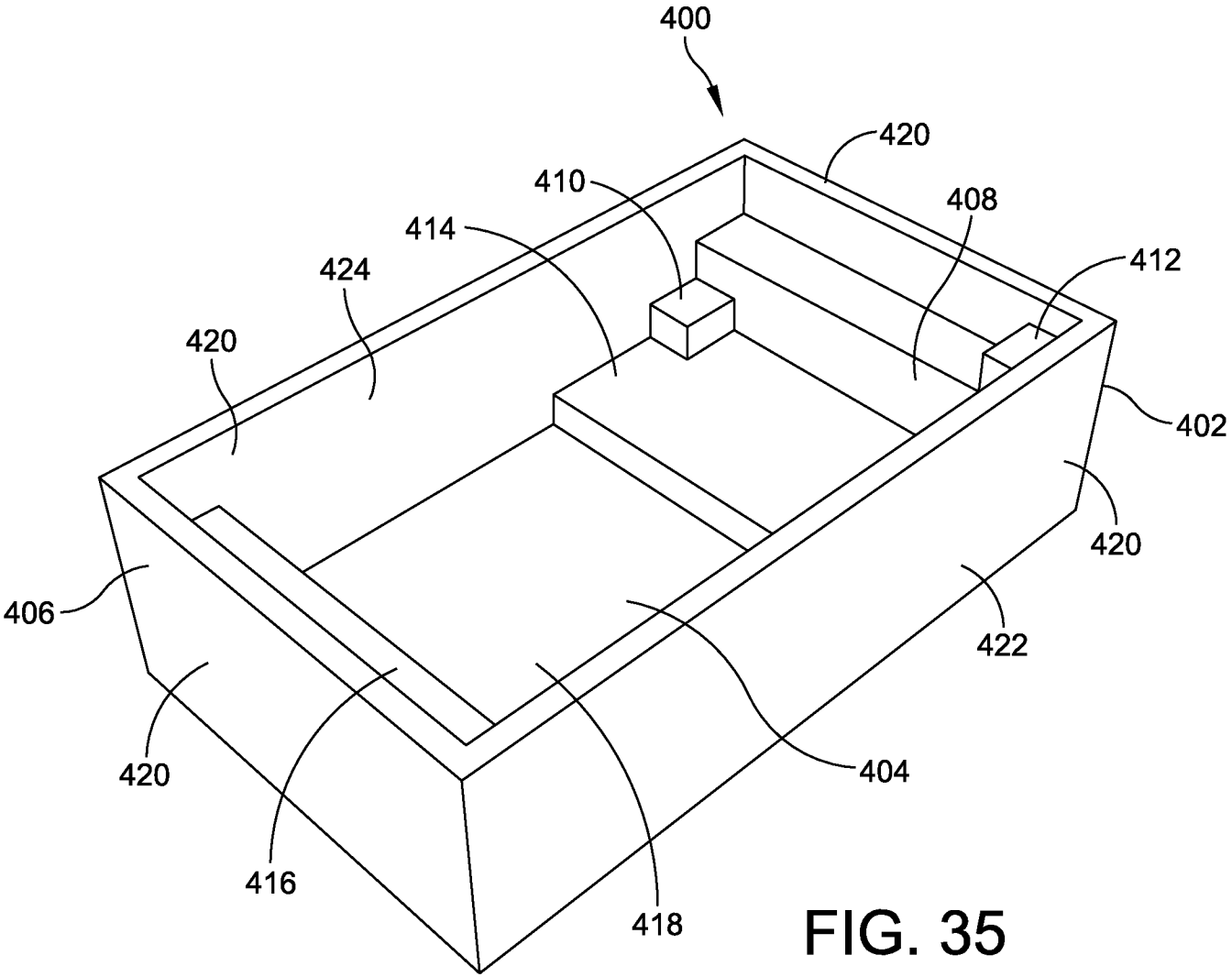
FIG. 35 is a perspective view of another embodiment of a modular pool according to the present disclosure.
Figure 36:
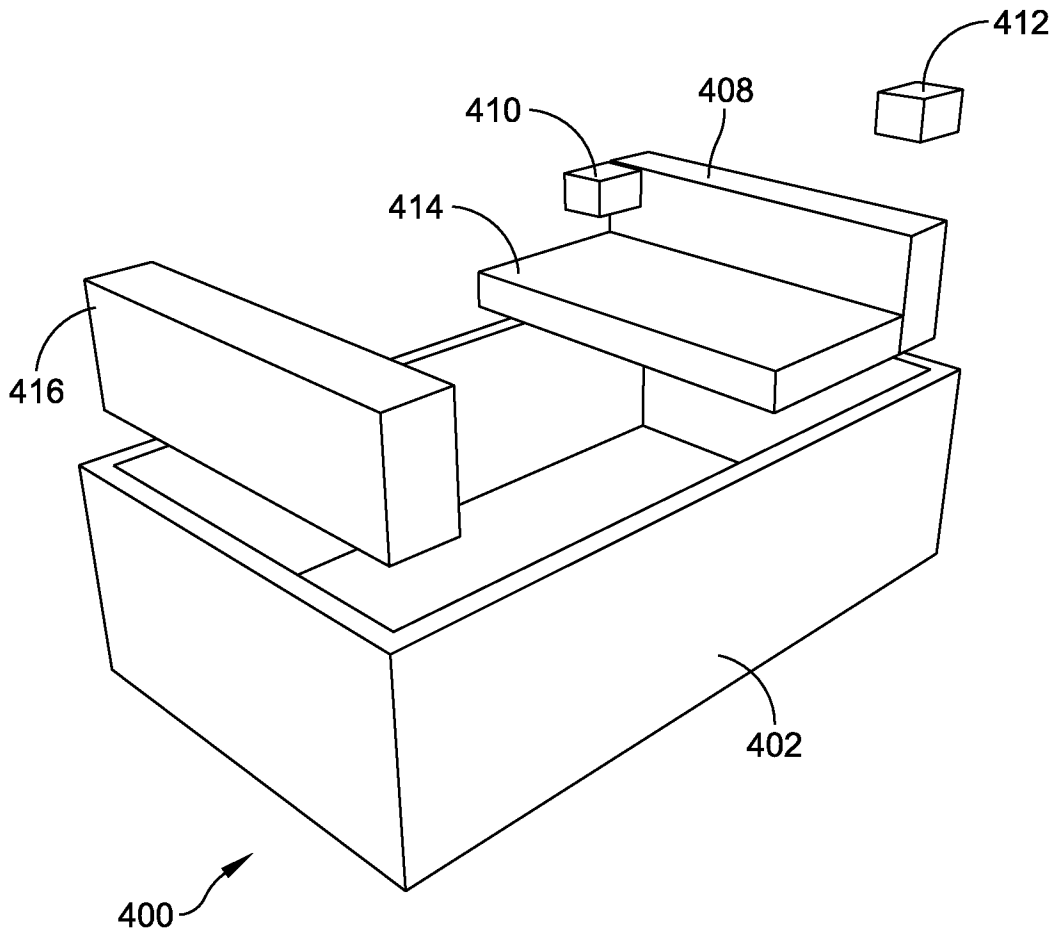
FIG. 36 is an exploded view thereof.
Figure 37:
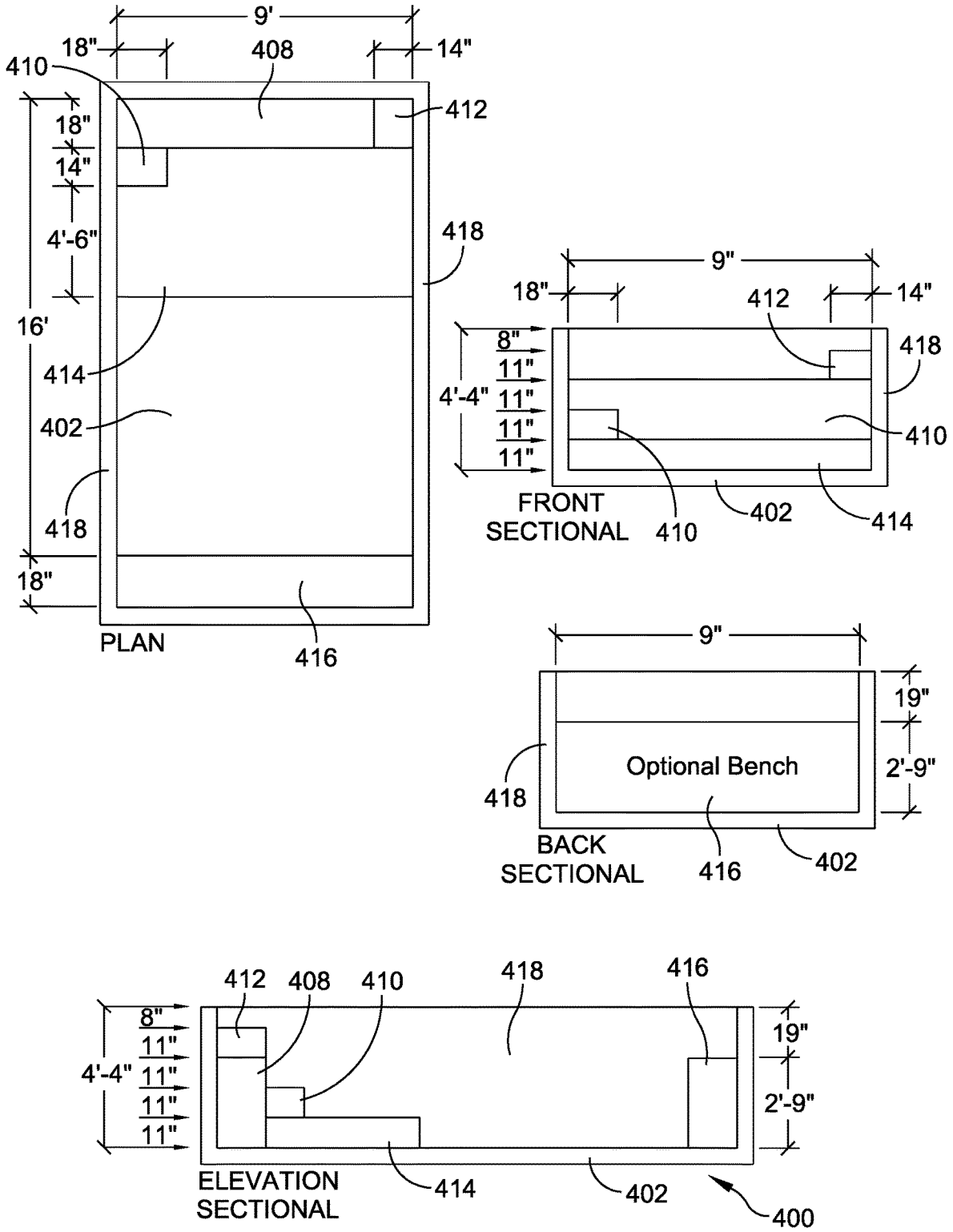
FIG. 37 is a set of schematic views thereof.

FIGS. 35-37 show another embodiment of a modular pool according to the present disclosure, generally indicated at 400.

The modular pool 400 includes a housing 402 having an integrally formed base unit 404 and riser unit 406. The modular pool 400 further includes a bench 408, a bottom step 410, a top step 412, platform 414, and second bench 416. The housing 402, the bench 408, the bottom step 410, and the top step 412 are all delivered to an installation site as precast concrete components.

The base unit 404 includes a bottom wall 418 made of precast concrete and, in some embodiments, including rebar to reinforce the concrete. The bottom wall 414 includes a lower surface that is configured to sit on a ground surface, such as a recessed surface in the ground at an installation site. The bottom wall 414 includes an upper surface that is configured to support internal modular units and/or a pool liner. For example, the pool liner can be secured to the upper surface by an adhesive.

Positioning the platform 414 on the bottom wall 418 adjacent the bench 408 yields a shallow portion of the interior volume of the pool, which may be beneficial to shorter individuals using the modular pool 400. In some embodiments, the platform 414 is a 4.5'×9'×11" slab that is made of precast concrete. In some embodiments, the water level above the platform 414 is 37 inches deep.

The riser unit 406 is made of precast concrete and includes rebar to reinforce the concrete. The riser unit 406 includes four side wall portions 420 that are connected at four corners. The four side wall portions of the riser unit 406 extend from an upper end of the riser unit that defines an open upper end of the pool to a lower end of the riser unit that is configured to be seated on the base unit 404.

The riser unit 406 includes an external surface 422 that is configured to be placed within a hole in the ground and an internal surface 424 that faces the interior volume of the pool structure. The internal surface 422 is configured to engage and/or support the pool liner. For example, the pool liner can be secured to the internal surface 422 by an adhesive.

In some embodiments, a modular pool assembly includes two or more of the modular pools described above that are positioned adjacent to each other, with each modular pool having an opening defined in one of its side walls so water may flow between the modular pools. In some embodiments, a modular pool assembly includes two modular pools described above that are positioned adjacent to each other, with a first opening in a first one of the modular pools being aligned with a second opening in a second one of the modular pools so water may flow between the first modular pool and the second modular pool.

Figure 38:
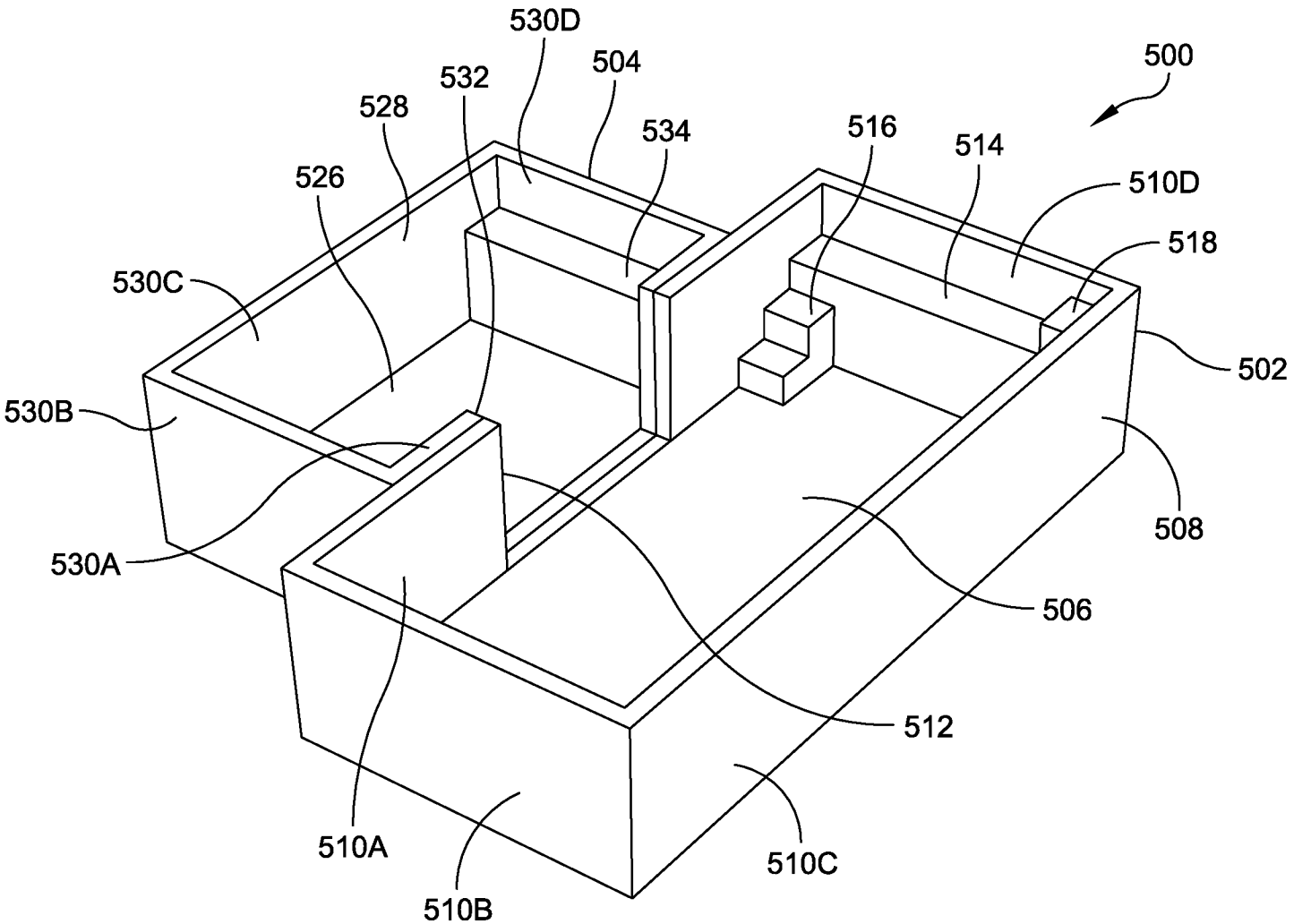
FIG. 38 is a perspective view of a first modular pool assembly according to the present disclosure.
Figure 39:
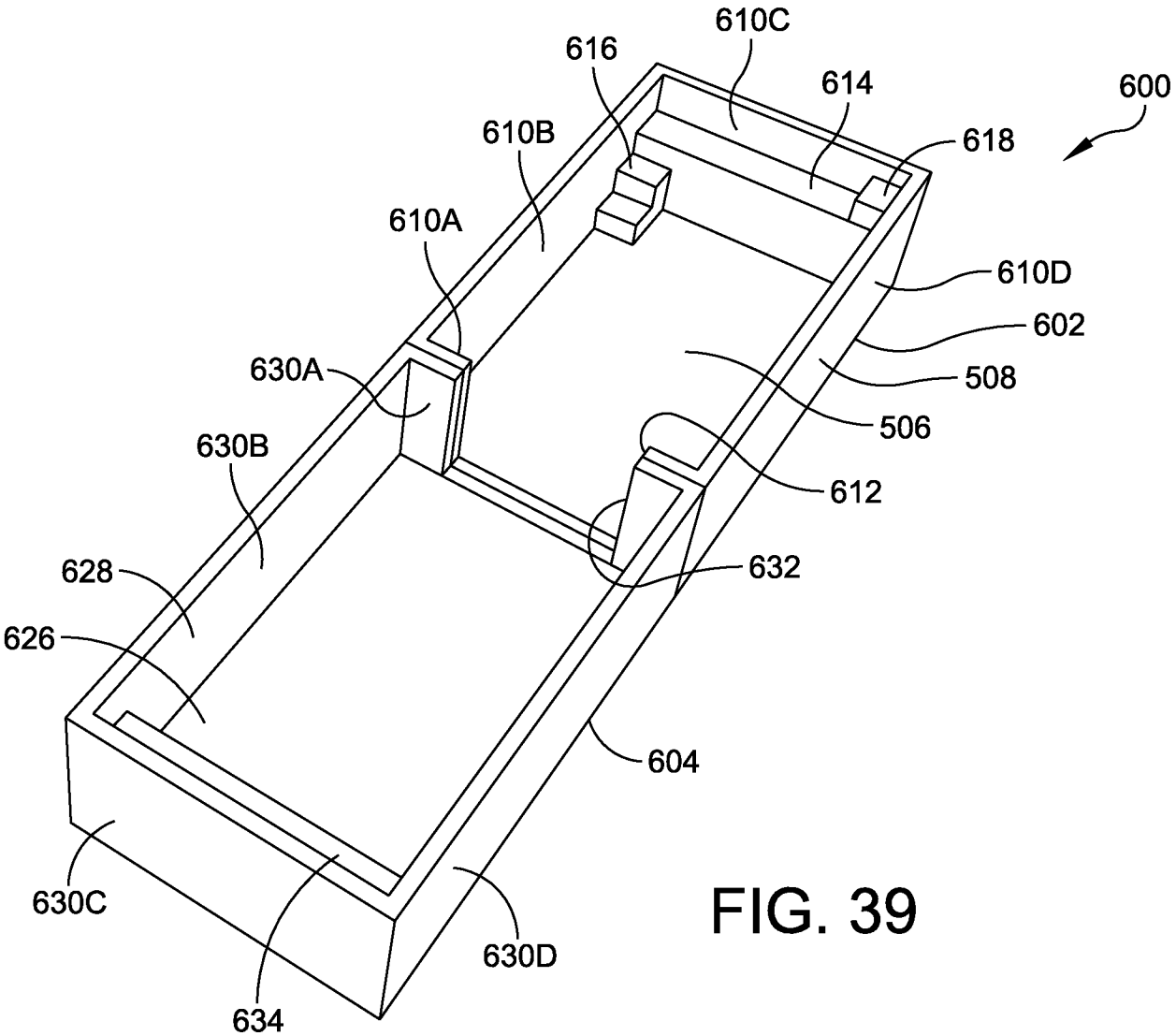
FIG. 39 is a perspective view of a second modular pool assembly according to the present disclosure.
Figure 40:
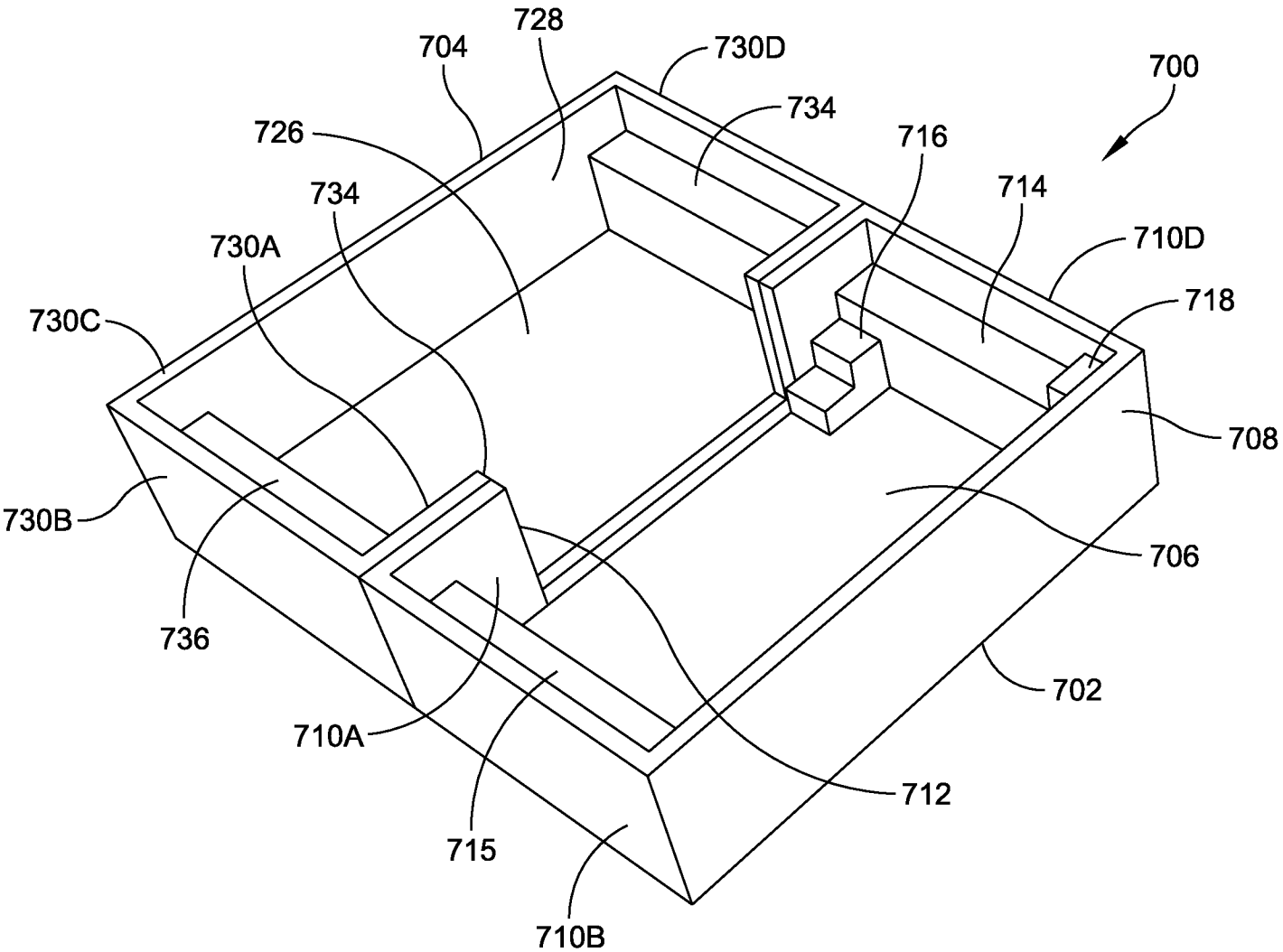
FIG. 40 is a perspective view of a third modular pool assembly according to the present disclosure.

FIGS. 38-40 show additional embodiments of modular pools according to the present disclosure, generally indicated at 500, 600, and 700. The modular pools 500, 600, and 700 are assembled by providing two adjacent plunge pools similar to the embodiments of FIGS. 1-37, but with portions of the side walls removed.

FIG. 38 shows a modular pool assembly, generally indicated at 500, including a first modular pool 502 and a second modular pool 504 that are positioned side-by-side. The first modular pool 502 defines a first internal volume for containing water and the second modular pool 504 defines a second internal volume for containing water. The first modular pool 502 and the second modular pool 504 are configured and positioned so that water may flow between first internal volume of the first modular pool 502 and the second internal volume of the second modular pool 504 when the modular pool assembly 500 is fully assembled.

The first modular pool 502 includes a base unit 506 and a riser unit 508, formed in a similar manner as the base units and riser units described above. The riser unit 508 includes four side walls 510A, 510B, 510C, and 510D. The first side wall 510A includes a hole 512 defining an opening so water may pass through the first side wall 510A to the second modular pool 504.

The first modular pool 502 also includes a bench 514, a first step 516, and a second step 518 positioned above the base unit 506.

The second modular pool 504 includes a base unit 526 and a riser unit 528, formed in a similar manner as the base units and riser units described above. The riser unit 528 includes four side walls 530A, 530B, 530C, and 530D. The first side wall 530A includes a hole 532 defining an opening so water may pass through the first side wall 530A to the first modular pool 502.

The second modular pool 504 also includes a bench 534 positioned above the base unit 526.

When the modular pool assembly 500 is assembled, the first side wall 510A of the first modular pool 502 is positioned in direct facing relation with the first side wall 530A of the second modular pool 504 and the hole 512 of the first side wall 510A of the first modular pool 502 is aligned with the hole 532 of the first side wall 530A of the second modular pool 504 so that water may flow directly between an interior volume of the first modular pool 502 and an interior volume of the second modular pool 504.

FIG. 39 shows a modular pool assembly, generally indicated at 600, including a first modular pool 602 and a second modular pool 604 that are positioned side-by-side. The first modular pool 602 defines a first internal volume for containing water and the second modular pool 604 defines a second internal volume for containing water. The first modular pool 602 and the second modular pool 604 are configured and positioned so that water may flow between first internal volume of the first modular pool 602 and the second internal volume of the second modular pool 604 when the modular pool assembly 600 is fully assembled.

The first modular pool 602 includes a base unit 606 and a riser unit 508, formed in a similar manner as the base units and riser units described above. The riser unit 608 includes four side walls 610A, 610B, 610C, and 610D. The first side wall 610A includes a hole 612 defining an opening so water may pass through the first side wall 610A to the second modular pool 604.

The first modular pool 602 also includes a bench 614, a first step 616, and a second step 618 positioned above the base unit 606.

The second modular pool 604 includes a base unit 626 and a riser unit 628, formed in a similar manner as the base units and riser units described above. The riser unit 628 includes four side walls 630A, 630B, 630C, and 630D. The first side wall 630A includes a hole 632 defining an opening so water may pass through the first side wall 630A to the first modular pool 602.

The second modular pool 604 also includes a bench 634 positioned above the base unit 626.

When the modular pool assembly 600 is assembled, the first side wall 610A of the first modular pool 602 is positioned in direct facing relation with the first side wall 630A of the second modular pool 604 and the hole 612 of the first side wall 610A of the first modular pool 602 is aligned with the hole 632 of the first side wall 630A of the second modular pool 604 so that water may flow directly between an interior volume of the first modular pool 602 and an interior volume of the second modular pool 604.

FIG. 40 shows a modular pool assembly, generally indicated at 700, including a first modular pool 702 and a second modular pool 704 that are positioned side-by-side. The first modular pool 702 defines a first internal volume for containing water and the second modular pool 704 defines a second internal volume for containing water. The first modular pool 702 and the second modular pool 704 are configured and positioned so that water may flow between first internal volume of the first modular pool 702 and the second internal volume of the second modular pool 704 when the modular pool assembly 700 is fully assembled.

The first modular pool 702 includes a base unit 706 and a riser unit 708, formed in a similar manner as the base units and riser units described above. The riser unit 708 includes four side walls 710A, 710B, 710C, and 710D. The first side wall 710A includes a hole 712 defining an opening so water may pass through the first side wall 710A to the second modular pool 704.

The first modular pool 702 also includes a first bench 714, a second bench 715, a first step 716, and a second step 718 positioned above the base unit 706.

The second modular pool 704 includes a base unit 726 and a riser unit 728, formed in a similar manner as the base units and riser units described above. The riser unit 728 includes four side walls 730A, 730B, 730C, and 730D. The first side wall 730A includes a hole 732 defining an opening so water may pass through the first side wall 730A to the first modular pool 702.

The second modular pool 704 also includes a first bench 734 and a second bench 736 positioned above the base unit 726.

When the modular pool assembly 700 is assembled, the first side wall 710A of the first modular pool 702 is positioned in direct facing relation with the first side wall 730A of the second modular pool 704 and the hole 712 of the first side wall 710A of the first modular pool 702 is aligned with the hole 732 of the first side wall 730A of the second modular pool 704 so that water may flow directly between an interior volume of the first modular pool 702 and an interior volume of the second modular pool 704.

In any of the embodiments of the present disclosure, the modular pool may be held together by the sheer weight of the riser unit and the internal component(s) on the base unit. In any of the embodiments of the present disclosure, the modular pool may be held together by a joining material in addition to the sheer weight of the riser unit and the internal component(s) on the base unit. In some embodiments, the joining material is an adhesion material. In some embodiments, the adhesion material is mortar. In some embodiments, the joining material consists essentially of mortar. In some embodiments, the joining material consists essentially of mortar and does not include significant mechanical connections, such as fasteners. In some embodiments, the joining material consists of mortar and does not include any other mechanical connections, such as fasteners.

The present disclosure includes a method of assembling a modular swimming pool. In some embodiments, the modular swimming pool includes a precast base unit having an upper surface, and a precast riser unit secured to the base. The precast riser unit has at least one internal surface. The upper surface of the precast base unit and the at least one internal surface of define the interior of the pool when the precast base unit and the precast riser unit are secured together. In some embodiments, the method comprises delivering the precast base unit and the precast riser unit to an installation site, positioning the precast base unit at the installation site, and securing the precast riser unit to the precast base unit so that the precast base unit and the precast riser unit define the interior of the modular swimming pool.

The method may include adding a liner that extends over the upper surface of the base unit and the internal surface of the riser unit.

The method may include forming the precast base unit and/or the precast riser unit.

The method may include using at least one blank to form at least one port on the riser unit in fluid communication with the interior of the pool. In some embodiments, the port is a skimmer port. In some embodiments, port is a channel that is configured to be connected to external piping.

Having thus described several aspects of at least one embodiment of this disclosure, it is to be appreciated various alterations, modifications, and improvements will readily occur to those skilled in the art. Such alterations, modifications, and improvements are intended to be part of this disclosure, and are intended to be within the spirit and scope of the disclosure. Accordingly, the foregoing description and drawings are by way of example only.

What is claimed is:

1. A modular swimming pool comprising:

a precast base unit including an uneven stepped surface having a first surface having a first height and a second surface having a second height greater than the first height, the first surface extending to a perimeter of the precast base unit;

a precast riser unit separate from the precast base unit and secured to the precast base unit, the precast riser unit including at least two connecting sidewall portions, at least one internal surface, an open upper end, and a lower surface configured to engage and align with the precast base unit so the lower surface of the precast riser unit and the first surface of the precast base unit are in facing engagement at the perimeter of the precast base unit; and at least one precast internal structure that is separate from the precast base unit and the precast riser unit, wherein the precast base unit and the at least one internal surface of the precast riser unit define an interior of the pool when the precast base unit and the precast riser unit are secured together, and wherein the at least one precast internal structure is configured to be arranged within the interior of the pool as desired by a user.

2. The modular swimming pool of claim 1, wherein the at least one precast internal structure includes at least one structure selected from a bench and a step.

3. The modular swimming pool of claim 1, consisting essentially of the precast base unit, the precast riser unit, and the at least one precast internal structure.

4. The modular swimming pool of claim 3, wherein the precast riser unit is seated on the precast base unit and the at least one precast internal structure is positioned on the upper surface of the base unit.

5. The modular swimming pool of claim 1, wherein the precast riser unit includes at least one port in fluid communication with the interior of the pool.

6. The modular swimming pool of claim 5, wherein the at least one port includes a skimmer port.

7. The modular swimming pool of claim 5, wherein the at least one port includes a channel configured to be connected to external piping.

8. The modular swimming pool of claim 1, wherein the precast base unit and the precast riser unit are secured together by a joining material.

9. The modular swimming pool of claim 8, wherein the joining material is an adhesive material.

10. The modular swimming pool of claim 9, wherein the joining material is mortar.

11. The modular swimming pool of claim 1, wherein the precast base unit and the precast riser unit are secured together by a joining material, and wherein the precast base unit and at least one of the at least one precast internal structure are secured together by the joining material.

12. The modular swimming pool of claim 11, wherein the joining material is an adhesive material.

13. The modular swimming pool of claim 1, wherein the precast base unit includes a side wall, and the stepped surface of the precast base unit is formed on the side wall of the precast base unit.

14. The modular swimming pool of claim 1, wherein the at least one precast internal structure includes a bench, a bottom step supported on the upper surface of the precast base unit, and a top step supported on the bench, each precast internal structure being separate from the precast base unit and the precast riser unit.

15. A method of assembling a modular swimming pool, the modular swimming pool including a precast base unit having an upper surface and an uneven stepped surface, a precast riser unit securable to the precast base unit, the precast riser unit being separate from the precast base unit, the precast riser unit including at least two connecting sidewall portions, at least one internal surface and a recess configured to engage and align with the corresponding uneven stepped surface of the precast base unit, the upper surface of the precast base unit and the at least one internal surface of the precast riser unit defining an interior of the pool when the precast base unit and the precast riser unit are secured together, and the modular swimming pool further including at least one precast internal structure that is separate from the precast base unit and the precast riser unit and is configured to be arranged within the interior of the pool as desired by a user, the method comprising:

delivering the precast base unit, and the precast riser unit, and the at least one precast internal structure to an installation site;

positioning the precast base unit at the installation site;

securing the precast riser unit to the precast base unit so that the precast base unit and the precast riser unit define the interior of the modular swimming pool; and positioning the at least one precast internal structure within the interior of the pool.

16. The method of assembly a modular swimming pool of claim 15, further comprising adding a liner that extends over the upper surface of the base unit and the internal surface of the riser unit.

17. The method of assembling a modular swimming pool of claim 15, further comprising using at least one blank to form at least one port on the riser unit in fluid communication with the interior of the pool.

18. The method of assembling a modular swimming pool of claim 17, wherein the port is a skimmer port.

19. The method of assembling a modular swimming pool of claim 17, wherein the port is a channel configured to be connected to external piping.

20. A method of assembling a modular swimming pool, the modular swimming pool including a precast base unit having an upper surface, a precast riser unit secured to the base, the precast riser unit including at least two connecting sidewall portions, having at least one internal surface, the upper surface of the precast base unit and the at least one internal surface of defining an interior of the pool when the precast base unit and the precast riser unit are secured together, the method comprising:

delivering the precast base unit and the precast riser unit to an installation site as separate precast components;

positioning the precast base unit at the installation site; and subsequently securing the precast riser unit to the precast base unit so that an upper surface of the precast base unit and at least one internal surface of the precast riser unit define the interior of the modular swimming pool.

* * * * *